US006002900A

United States Patent [19]

Ishiyama

[11] Patent Number: 6,002,900

[45] Date of Patent: Dec. 14, 1999

[54] IMAGE FORMING METHOD, IMAGE FORMING APPARATUS AND PROCESS CARTRIDGE

[75] Inventor: Harumi Ishiyama, Numazu, Japan

[73] Assignee: Canon Kabushiki Kaisha, Tokyo, Japan

[21] Appl. No.: 09/094,625

[22] Filed: Jun. 15, 1998

[30] Foreign Application Priority Data

Jun. 13, 1997 [JP] Japan ..... 9-156807

[51] Int. Cl.[6] ..... G03G 15/30; G03G 15/02

[52] U.S. Cl. ..... 399/149; 399/174; 430/109; 430/111; 430/106.6

[58] Field of Search ..... 399/168, 174–176, 399/149, 159, 111; 361/226, 214; 430/105, 109, 111, 106.6

[56] References Cited

U.S. PATENT DOCUMENTS

| | | | |
|---|---|---|---|
| 5,432,033 | 1/1995 | Asanae et al. | 430/35 |
| 5,592,264 | 1/1997 | Shigeta et al. | 399/175 |
| 5,698,354 | 12/1997 | Ugai et al. | 430/111 X |
| 5,729,802 | 3/1998 | Hirabayashi et al. | 399/174 |
| 5,815,777 | 9/1998 | Hirabayashi | 399/174 |
| 5,822,659 | 10/1998 | Ishiyama | 399/175 |
| 5,824,445 | 10/1998 | Ochiai et al. | 430/111 X |
| 5,835,821 | 11/1998 | Suzuki et al. | 399/174 X |

FOREIGN PATENT DOCUMENTS

| | | |
|---|---|---|
| 0708376 | 4/1996 | European Pat. Off. . |
| 0709746 | 5/1996 | European Pat. Off. . |
| 0801334 | 10/1997 | European Pat. Off. . |
| 0801335 | 10/1997 | European Pat. Off. . |
| 0805378 | 11/1997 | European Pat. Off. . |

OTHER PUBLICATIONS

Patent Abstracts of Japan, vol. 009, No. 048 (P–338), Feb. 1985 of JP 59–185350.

*Primary Examiner*—Matthews S. Smith

*Attorney, Agent, or Firm*—Fitzpatrick, Cella, Harper & Scinto

[57] ABSTRACT

Improvement has been made in an image forming method comprising charging electrically an image holding member, forming a latent electrostatic image on the image holding member, developing the latent image with a toner, transferring the toner image onto a toner image receiving medium, and recovering untransferred toner. In this method, a magnetic brush formed from magnetic particles electrifies the image holding member by contact with the image holding member surface, recovers temporarily at least a part of the toner remaining on the image holding member after the image transfer, and transfers the recovered toner further again onto the image holding member, wherein the toner has a weight-average particle diameter of not larger than ⅓ of average particle diameter of the magnetic particles and the magnetic particles contain particles of diameter of not larger than ⅓ of the average particle diameter of the magnetic particles at a content ranging from 0 to 50% by volume. Thereby, contamination of the magnetic particles by the toner and interception of the electric conduction path in the magnetic brush are prevented, and deterioration of the toner is prevented without excessive shearing of the recovered toner with magnetic particles.

72 Claims, 11 Drawing Sheets

IMAGE FORMING METHOD, IMAGE FORMING APPARATUS AND PROCESS CARTRIDGE

BACKGROUND OF THE INVENTION

1. Field of the Invention

The present invention relates to an image forming method, and an image forming apparatus applicable to copying machines, printers, and facsimile machines. In particular, the present invention relates to an image forming method, an image forming apparatus, and a process cartridge in which the toner remaining on a photosensitive member after the image transfer is recovered by a development device.

2. Related Background Art

For miniaturizing the image forming apparatus, several techniques are known for cleaning an untransferred toner remaining on a photosensitive member after image transfer (hereinafter referred to as a remaining toner) simultaneously with electric charging or simultaneously with development by charging apparatus or developing apparatus.

Electric charging has been conducted conventionally by corona charging. However, the charging method is shifting to contact charging which generates less ozone by electric discharge from the standpoint of ecology. The contact charging member includes rollers, blades, fur brushes, and magnetic brushes.

However, in the case where a remaining toner on an image-holding member after image transfer is recovered temporarily by a magnetic brush charger formed by magnetic attraction of magnetic particles, some high-resistance toner particles (remaining toner after image transfer) enter an magnetic brush charger to lower the charging performance of the magnetic brush charger disadvantageously.

The toner recovered by the magnetic brush charger is again transferred onto the image-holding member, and is collected in the development device in a development step. However, the toner deteriorates in the magnetic brush charger, and causes problems as below. The recovered toner is not completely transferred onto the image holding member; the toner accumulates in the magnetic brush charger during the repeated image formation to lower the charging ability; the toner being transferred from the magnetic brush charger onto the image holding member and having been deteriorated in the magnetic brush charger cannot be recovered completely, causing fogging of the images; and the deteriorated toner recovered into the development device cannot be sufficiently utilized for the development, causing fogging of the images and scattering of the toner.

SUMMARY OF THE INVENTION

The present invention intends to provide an image forming method and to provide an image forming apparatus which does not involve the above disadvantages of the prior art.

The present invention intends also to provide an image forming method, an image forming apparatus, and a process cartridge, which has stable charging properties without employing a separate cleaning device such as a cleaning blade in contact with the photosensitive member surface.

The present invention further intends to provide an image forming method, an image forming apparatus, and a process cartridge, which retards deterioration of a remaining toner recovered from an image holding member into a magnetic brush charger, having excellent toner transfer properties from the magnetic brush charger to the image holding member, and excellent recovery properties of toner on the image holding member to a developing apparatus, and being capable of keeping the developing properties of the toner recovered into the developing device.

The image forming method of the present invention comprises a charging step for electrifying an image holding member for holding an electrostatic latent image by charging means; an electrostatic latent image formation step for forming an electrostatic latent image on the electrified image holding member; a development step for developing the latent image held on the image holding member with a toner stored in a development device to form a toner image; a transfer step for transferring the toner image onto a transfer-receiving medium; and a recovery step for recovering the toner remaining after the image transfer on the image holding member simultaneously with the development by the development device, wherein the charging means is a magnetic brush charger formed from magnetically confined magnetic particles; the magnetic brush charger electrifies the image holding member by bringing the magnetic brush of the magnetic brush charger into contact with the surface of the image holding member, recovers temporarily at least a part of the toner remaining on the image holding member after the image transfer, and transfers the recovered toner further again onto the image holding member; the toner has a weight-average particle diameter ($D_4$) of not larger than ⅓ of average particle diameter of the magnetic particles; and the magnetic particles contain particles of diameter of not larger than ⅓ of the average particle diameter of the magnetic particles at a content ranging from 0 to 5.0% by volume.

The image forming apparatus of the present invention comprises an image holding member for holding an electrostatic latent image; a charging means for electrifying the image holding member; an electrostatic image forming means for forming an electrostatic latent image on the electrified image holding member; a development device storing a toner for toner image formation for developing the electrostatic latent image formed on the image holding member with the toner to form a toner image; and a transfer means for transferring the toner image onto a transfer-receiving medium, wherein the development device functions also to recover the toner remaining on the image holding member after the image transfer, the charging means is a magnetic brush charger formed from magnetically confined magnetic particles; the magnetic brush charger electrifies the image holding member by bringing the magnetic brush of the magnetic brush charger into contact with the surface of the image holding member, recovers temporarily at least a part of the toner remaining on the image holding member after the image transfer, and transfers the recovered toner further again onto the image holding member; the toner has a weight-average particle diameter ($D_4$) of not larger than ⅓ of average particle diameter of the magnetic particles; and the magnetic particles contain particles of diameter of not larger than ⅓ of the average particle diameter of the magnetic particles at a content ranging from 0 to 5.0% by volume.

The process cartridge of the present invention is detachably mountable to a main assembly of an image forming apparatus, and comprises an image holding member for holding an electrostatic latent image; a charging means for electrifying the image holding member; and a development device storing a toner for toner image formation for developing the electrostatic latent image formed on the image holding member with the toner to form a toner image, wherein the development device functions also to recover the toner remaining on the image holding member after the image transfer, the charging means is a magnetic brush charger formed from magnetically confined magnetic particles; the magnetic brush charger electrifies the image holding member by bringing the magnetic brush of the magnetic brush charger into contact with the surface of the image holding member, recovers temporarily at least a part of the toner remaining on the image holding member after the image transfer, and transfers the recovered toner further again onto the image holding member; the toner has a weight-average particle diameter ($D_4$) of not larger than ⅓ of average particle diameter of the magnetic particles; and the magnetic particles contain particles of diameter of not larger than ⅓ of the average particle diameter of the magnetic particles at a content ranging from 0 to 5.0% by volume.

DESCRIPTION OF THE PREFERRED EMBODIMENTS

The inventors of the present invention made comprehensive investigation on the image forming method employing a development-and-cleaning system in which a development device also functions for recovering a remaining toner after image transfer on an image holding member during developing step, a remaining toner on an image holding member after image development is recovered temporarily by a magnetic brush charger, and the recovered toner is transferred again onto the image holding member. As the results, the inventors found that contamination of the magnetic particles by the toner and interception of the electric conduction path through the magnetic brush can be prevented and deterioration of the toner can be prevented without excessive shearing of the recovered toner by magnetic particles by controlling the toner particles to have a weight-average particle diameter ($D_4$) not larger than ⅓ of average particle diameter of the magnetic particles in the magnetic brush charger. Thereby, improvement can be achieved in the charging property of the magnetic brush charger, transferability of the toner from the magnetic brush charger to the image holding member, recoverablilty of the toner transferred to the image holding member, and developing properties of the toner recovered by the development device, which enables satisfactory image formation on many printing sheets.

In the image forming method employing the development-and-cleaning system, a development section for image development, a transfer section for image transfer, and charging section for charging of the image holding member are placed in the named order along the direction of movement of the surface of the image holding member, and no cleaning member is provided for recovering a remaining toner from the surface of the image holding member by contact with the surface between the transfer section and the charging section and between the charging section and the development section. This is suitable for compaction of the entire apparatus.

The present invention is described below in more detail.

Figure 1:
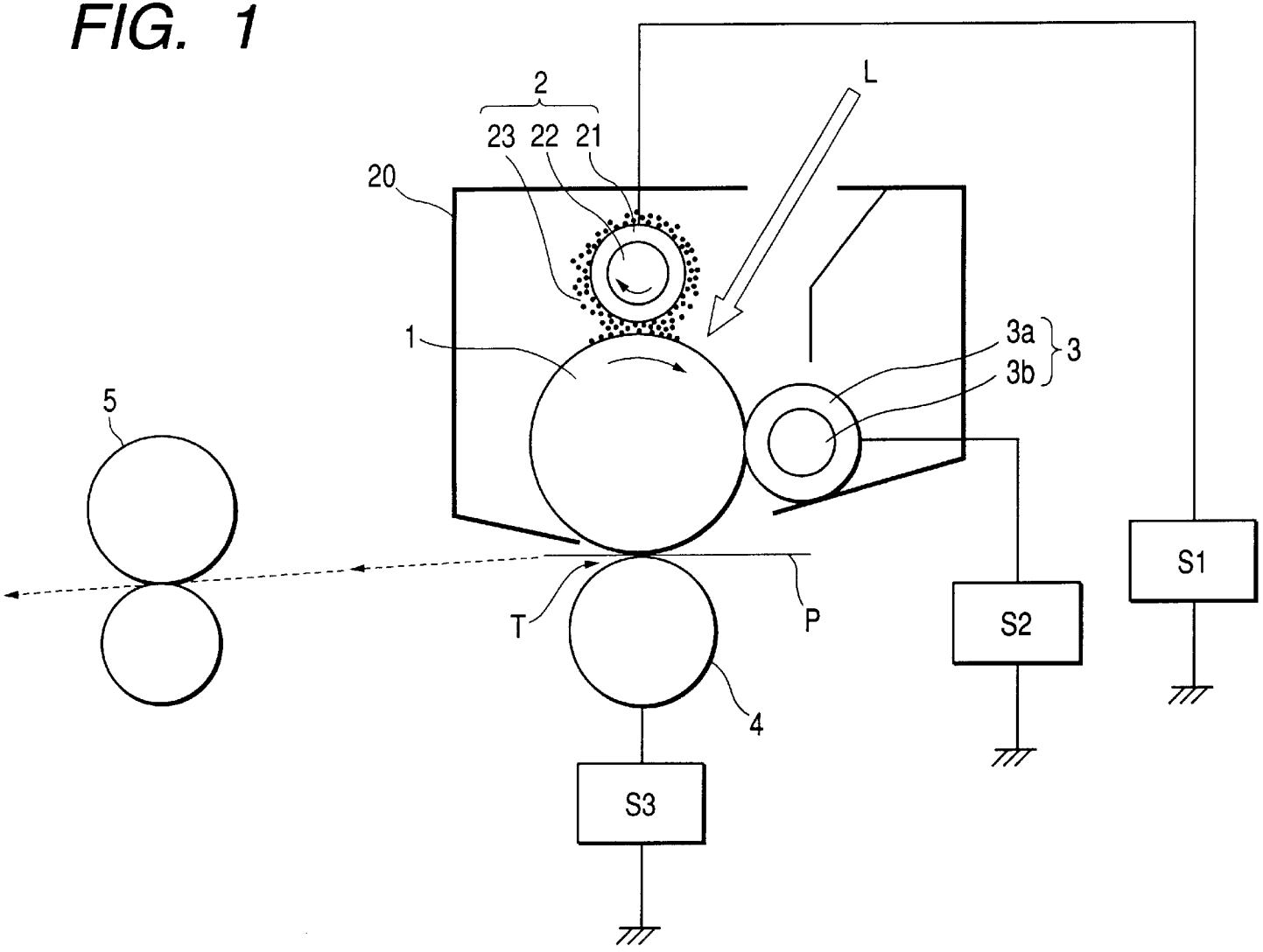
FIG. 1 illustrates schematically an image forming apparatus for practicing the image forming method of the present invention.

The process of image formation of the present invention is explained by reference to FIG. 1 showing schematically an image forming apparatus. The image forming apparatus shown in FIG. 1 is a laser beam printer utilizing an electrophotographic process.

In FIG. 1, an electrophotographic photosensitive member 1 is a rotating photosensitive drum as an image holding member (hereinafter referred to as a photosensitive drum), having usually a diameter ranging from 10 to 180 mm, preferably from 10 to 30 mm for miniaturization of the entire apparatus. The photosensitive drum rotates in a clockwise direction as shown by the arrow mark at a process speed (peripheral speed) of 24 to 400 mm/sec usually.

A magnetic brush charger 2 is a charging means brought into contact with the photosensitive drum 1. This magnetic brush charger 2 is constituted of a rotatable nonmagnetic charging sleeve 21, a magnet 22 enclosed therein, and charging magnetic particles 23 forming a magnetic brush by magnetic force on the charging sleeve 21. To the magnetic brush 2, a charging DC bias ranging preferably from −300 V to −1 kV is applied from a charging bias power source S1 to charge electrically uniformly the peripheral surface of the rotating photosensitive drum 1 at nearly the same voltage ranging from −300 V to −1 kV as the applied voltage.

The rotation of the electroconductive sleeve and the photosensitive drum is controlled to be at the peripheral speed ratio below. The peripheral speed ratio is defined by the equation below:

$$\text{Peripheral speed ratio } \% = [((\text{Peripheral speed of electroconductive sleeve}) - (\text{Peripheral speed of photosensitive drum})) \div (\text{Peripheral speed of photosensitive drum})] \times 100$$

The peripheral speed ratio is preferably higher for higher injectability. However, the ratio is preferably lower in view of the cost and safety of the apparatus so far as the injectability is secured. In practice, when the magnetic brush is brought into contact with the photosensitive drum at a low moving speed in the same movement direction, the magnetic particles of the magnetic brush tend to adhere to the photosensitive drum. Therefore, the ratio is preferably higher than ±100%. However, at the ratio of −100%, the brush is in a stopping state, and the electrification is liable to be insufficient in a shape of the stopping brush on the photosensitive surface to impair the image in the shape of the stopping brush. When the movement direction of the magnetic brush and that of the photosensitive drum is reverse, the movement speed (peripheral speed) of the magnetic brush at the same absolute value of peripheral speed ratio is lower in comparison with the case of the same rotation direction, thereby the durability of the magnetic brush charger is improved and power consumption for driving the magnetic brush is reduced advantageously. The peripheral speed ratio of preferably in the range from −150% to −300%.

A transfer roller 4 as the transfer means is brought into contact at a prescribed contact pressure onto the photosensitive drum 1. With delivery of a transfer-receiving medium P as a recording medium from a recording medium-delivery section not shown in the drawing, the transfer-receiving medium P is introduced at a prescribed timing to a pressure-contact nip (transfer section) T between the photosensitive drum 1 and the transfer roller 4 of a medium level of resistivity. A prescribed transfer bias voltage is applied from a transfer bias applying source S3 to the transfer roller 4. The transfer-receiving medium P introduced to the transfer section T is delivered through the transfer section T, and the toner image formed on the surface of the photosensitive drum 1 is successively transferred onto the surface of the transfer-receiving medium P by the electrostatic force and the pressure. The transfer-receiving medium P having received the toner image is released from the face of the photosensitive drum 1, then introduced to a fixation device 5 of a thermal fixation type or the like to have the toner image fixed, and discharged as an image carrying sheet (print, or copy) out of the apparatus.

After transfer of the toner image from the photosensitive drum face to the transfer-receiving medium P, at least a part of the remaining toner is recovered by the magnetic brush charger 2 in the next stage. After passing through the charging nip, at least a part of the recovered toner is released and is transferred again onto the photosensitive drum 1. In the development step after the light image exposure, excess toner is recovered to the development device, and the toner is used repeatedly.

The image forming apparatus shown in FIG. 1 is a cartridge type apparatus. The cartridge 20 is constituted of three process devices: a photosensitive drum 1, a magnetic brush charger 2, and a development device 3 in integration. This cartridge is mountable to and detachable from the main assembly of the image forming apparatus. However the image forming apparatus of the present invention is not limited thereto.

The toner for the above image forming process has preferably a weight-average particle diameter ($D_4$) of not larger than ⅓ of average particle diameter of the magnetic particles, more preferably in the range of from 1/20 to ⅓ thereof. Thereby, contamination of magnetic particles with the toner and interception of the electric conduction path by the toner in the magnetic brush are prevented, and deterioration of the toner recovered in magnetic brush charger is prevented without excessive shearing of the recovered toner by magnetic particles.

Figure 2:
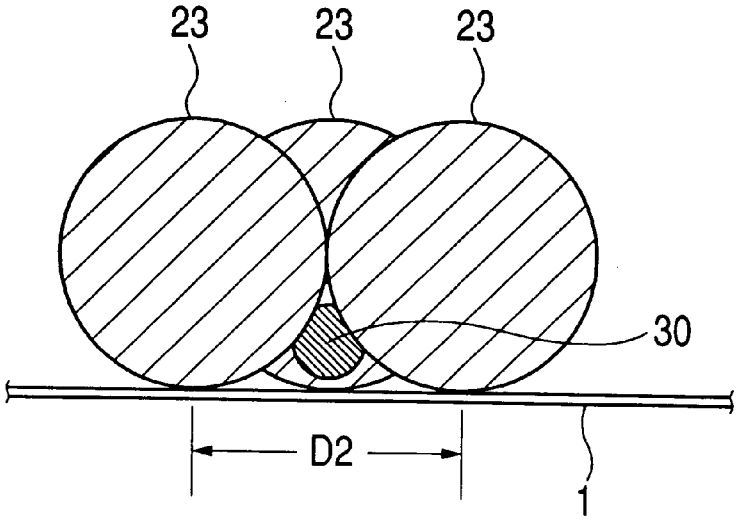
FIG. 2 is a drawing for explaining the principle of the present invention.

Drop of charging ability of the charging brush caused by the remaining toner after the image transfer will be prevented if the contaminating toner particles can be enclosed in the inherent interspace of the magnetic brush and the photosensitive member. The state of contact of the magnetic brush and the photosensitive member is explained by reference to FIG. 2. In FIG. 2, the photosensitive drum 1 is considered to be flat since the curvature radius of the surface is sufficiently large in comparison with the magnetic particles 23 and the toner particles 30. In the closest packing state of the magnetic particles 23, the centers of the magnetic particles are placed in positions of an equilateral triangle. In this state, the largest particle diameter capable of fitting the interspace has a diameter of (⅓)R, where R represents the particle diameter of the magnetic particle. Therefore, a preferred particle diameter of the developing toner is not larger than (⅓)R for the magnetic particle diameter R. Thereby, the remaining toner can be held in the interspace of the magnetic particles and the photosensitive member without enlarging the gap between the magnetic particles and without affecting the electrification by charge injection. Even if the amount of the remaining toner is larger, the toner particles are held in the interior of the magnetic brush, not affecting the contacting area of the contact face between the photosensitive drum surface and the magnetic particles. Even when some toner particles which are held in the interior of the magnetic brush intercept an electric conduction path, electric current can flow through another electric conduction path.

The toner particles contaminating the magnetic brush are electrified to inherent charging polarity of the toner (e.g., negative) by friction between toner particles, friction between the toner and the magnetic particles, and friction between the toner and the photosensitive member. Thereby, the toner particles are released electrically by the potential difference between the magnetic brush potential and the photosensitive member surface potential at the outlet of the nip from the magnetic brush onto the photosensitive member. Therefore, the remaining toner after image transfer does not accumulate in the magnetic brush, so that the electrification will not be rapidly impaired.

Figure 3:
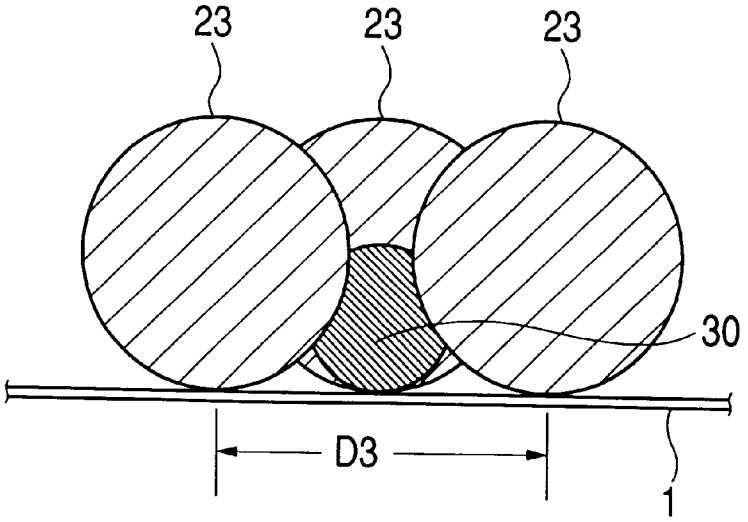
FIG. 3 is a drawing explaining the principle in a comparative example.

On the other hand, when the toner has a weight-average particle diameter ($D_4$) larger than ⅓ of the average particle diameter of the magnetic particles, the toner particle entering the interspace of the magnetic particles as shown in FIG. 3 makes the distance between the magnetic particles D3 larger than that of the closest packing state D2 to cause a region of insufficient electrification locally. When the amount of the remaining toner in the magnetic brush has increased after printing of many sheets, the toner particles having a larger weight-average particle diameter is liable to intercept the electric conduction path of the magnetic brush and to lower the charging properties thereof. Moreover, the remaining toner in the magnetic brush is subjected to strong shear between the magnetic particles, which tends to cause gradual contamination of the surface of the magnetic particles to impair the charging properties with the number of the printed sheets, and to cause deterioration of toner by embedding of the external additive on the toner particle surface into the particle, or aggregation or disintegration of the toner particles.

When the toner becomes deteriorated, various problems arises. The toner is not properly electrified within the magnetic brush. Thereby, the toner particles cannot be transferred from the magnetic brush charger to the photosensitive drum, accumulating in the magnetic brush charger to impair significantly the charging properties. The deteriorated toner, even when it is transferred from the magnetic brush onto the photosensitive drum, is not recovered from the non-image portion of the electrostatic latent image to cause image fogging. Even when the deteriorated toner re-transferred from the magnetic brush charger onto the photosensitive drum is recovered by the development device in the development step, the toner recovered cannot be properly developed, thereby causing fogging or scattering.

The magnetic particles in the present invention contains particles of a diameter of not larger than ⅓ of the average particle diameter thereof preferably at a content of not more than 5.0% by volume (0 to 5.0% by volume), more preferably not more than 4.5% by volume (0 to 4.5% by volume) for steady electrification. At the content of higher than 5% by volume of the above smaller particles, a toner particle having entered the interspace of the magnetic particles of the size of not larger than ⅓ of the average diameter will impair the electric conduction between the magnetic particles and to cause failure of electrification.

Further, the magnetic particles in the present invention contains particles of a diameter of not smaller than 1.5 times the average particle diameter preferably at a content of not more than 20.0% by volume (0 to 20.0% by volume), more preferably not more than 15.0% by volume (0 to 15.0% by volume) for uniform charging of the image holding member and prevention of scratching of the image holding member surface. At the content of more than 20% by volume of the above larger particles, the charging tends to be nonuniform, and the surface of the image holding member may be scratched.

Furthermore, the magnetic particles in the present invention contains particles of a diameter of from ⅔ to ⅘ of the average particle diameter preferably at a content of 60.0% by volume or more (60.0 to 100% by volume), more preferably 65.0% by volume or more (65.0 to 100% by volume) for uniform charging of the image holding member and for good electrification. At the content of less than 60.0% by volume of the particles of the above diameter range, the electrification tends to be nonuniform, and electrification can fail.

The magnetic particles in the present invention has an average particle diameter in the range preferably from 10 to 100 μm, more preferably from 15 to 50 μm. With the average diameter of the magnetic particles of larger then 100 μm, charging ability is lower because of smaller total contact area to the surface of the photosensitive drum owing to the roughness of the magnetic brush. With the average diameter of the magnetic particles of less than 10 μm, the magnetic confining force of the magnetic particles is less, tending to be transferred from the magnetic brush to the photosensitive drum. Therefore, after use for a long time, the amount of the magnetic particles may become deficient to cause failure of electrification, or the transferred magnetic particles may affect adversely the later steps of development, toner image transfer, and fixation.

The average particle diameter and the particle size distribution of the magnetic particles were measured in the present invention by use of a laser diffraction particle size tester HELOS (manufactured by JEOL Ltd.) in combination with a dry classification unit RODOS (manufactured by Nihon Denshi) under measuring conditions, lens focus distance of 200 mm, dispersion pressure of 3.0 bar, measuring time of 1 to 2 sec, for channels shown in Table 1 in the range from 0.5 μm to 350.0 μm. In the volume distribution, 50% particle diameter (median diameter) was taken as the average diameter, and respective volume percentages were derived for frequency distribution based on volume. In practical measurement, the particle diameters were measured in the range from not less than 0.05 μm to less than 86 μm.

In the present invention, a laser diffraction particle size distribution measuring device HELOS used for measuring particle size distribution is a device employing a Flanhofer diffraction principle. This measuring principle are briefly explaned as follows: diffraction image is produced on focal surface of the lens on the opposite side of a laser source when a laser beam is irradiated on particles to be measured, the diffraction image is detected by a detector and the operation treatment is carried out to calculate particle size distribution of particles to be measured.

The magnetic particles having the above average particle diameter, and the specified particle size distribution can be prepared, for example, by classification by use of sieves. For precise classification, sieves of appropriate opening sizes are used, and the sieving is preferably repeated several times. Control of the shape of the mesh opening by metal plating is effective.

The method of the classification further includes air classification in which particles are allowed to fly in the air and are classified by gravity difference, and wet classification in which particles are mixed with a liquid such as water and are classified by sedimentation velocity difference.

The particulate toner in the present invention has a weight-average particle diameter ($D_4$) ranging preferably from 1 to 20 μm, more preferably from 2 to 10 μm, still more preferably from 4 to 8 μm. The toner having a weight-average toner particle diameter ($D_4$) of larger than 20 μm lowers fine-line reproducibility and image gradation, and when a larger toner particle enters the charging magnetic blush, it prevents remarkably the contact of the magnetic brush with the photosensitive drum to lower the injection charging properties. The toner having a weight-average toner particle diameter ($D_4$) of smaller than 1 μm tends to be scattered in the periphery of an image portion to cause fogging, and when it adheres to magnetic particles, it is fixed onto the magnetic particle surface to prevent transfer of the toner onto the photosensitive member and recovery by a development device, lowering the charging ability of the magnetic brush with lapse of time of use.

The particle size distribution of the toner in the present invention was measured with Coulter Counter TA-II or Coulter Multisizer (manufactured by Coulter Co.). The electrolyte solution therefor was prepared with a first reagent grade sodium chloride as aqueous 1% NaCl solution. The electrolyte solution may be ISOTON R-II (produced by Coulter Scientific Japan Co.). In the measurement, 0.1 to 5 mL of a surfactant, preferably an alkylbenzenesulfonate salt as a dispersant, and 2 to 20 mg of a measurement sample were added to 100 to 150 mL of the aforementioned aqueous electrolyte solution. The suspension of the sample in the electrolyte solution was treated for dispersion with an ultrasonic disperser for about 1 to 3 minutes. With the above measurement apparatus by use of a 100 μm aperture, the volume of the toner of the particle diameter of not smaller than 2 μm was measured to obtain volume distribution. Therefrom, the weight-average particle diameter ($D_4$) was calculated by taking medians as the values for the respective channels.

When the weight-average particle diameter of the toner was less than 4 μm by the above method, the aperture was replaced by the one of 50 μm, and the volume of the toner particles of the particle diameter of not smaller than 0.5 μm was measured to obtain volume distribution. Therefrom, the weight-average particle diameter ($D_4$) was calculated by taking medians as the values for the respective channels.

In the measurement, 13 channels were employed: 2.00 μm to less than 2.52 μm, 2.52 μm to less than 3.17 μm, 3.17 μm to less than 4.00 μm, 4.00 μm to less than 5.04 μm, 5.04 μm to less than 6.35 μm, 6.35 μm to less than 8.00 μm, 8.00 μm to less than 10.08 μm, 10.08 μm to less than 12.70 μm, 12.70 μm to less than 16.00 μm, 16.00 μm to less than 20.20 μm, 20.20 μm to less than 25.40 μm, 25.40 μm to less than 32.00 μm, and 32.00 μm to 40.30 μm.

Figure 4:
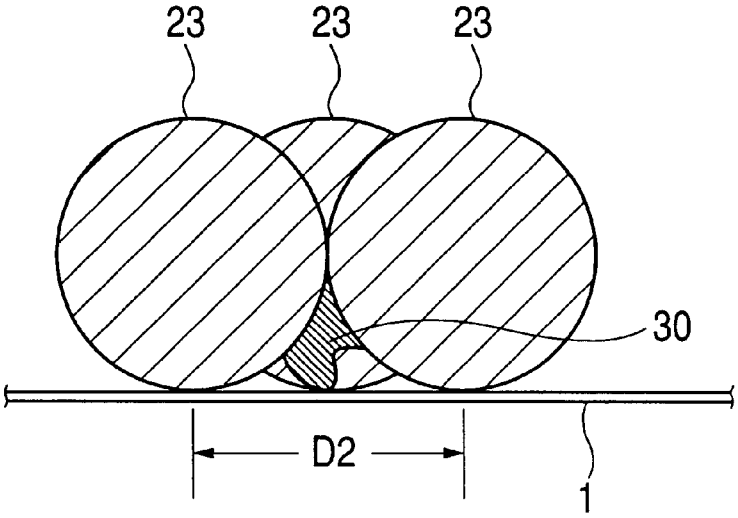
FIG. 4 is a drawing explaining the principle in a comparative example.
Figure 5:
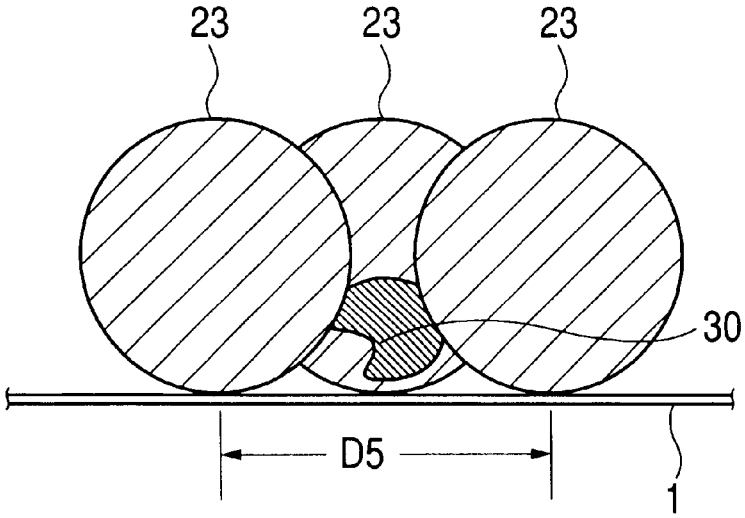
FIG. 5 is a drawing explaining the principle in a comparative example.

The toner particles in the present invention have desirably a shape nearer to a sphere for the stability of the charging property. If the toner particle shape is extremely ellipsoidal or the toner particle surface is rough, the toner particle in the interspace in the magnetic particles can enlarge the distance between the magnetic particles from the closest packing state (distance D2 in closest packing in FIG. 2), even if the weight-average particle diameter ($D_4$) is not larger than ⅓ of the average diameter of the magnetic particles. On the other hand, a nearly spherical toner particle will not enlarge the distance between the magnetic particles of 2D irrespectively of the direction of the toner particle in the interspace of the magnetic particles, not impairing the charging properties. For example, a toner particle of an irregular shape placed in the direction as shown in FIG. 4 does not change the magnetic particle distance of the closest packing state D2, whereas the same particle in the direction as shown in FIG. 5 enlarges the distance to D5 to prevent uniform charging.

The degree of the sphericity of the toner is defined by shape factors SF-1 and SF-2 in the present invention. The shape factors SF-1 and SF-2 were measured by means of FE-SEM (S-800) (manufactured by Hitachi Seisakusho) as follows. 100 Toner particles were selected as samples at random. The image information was introduced through an interface to an image analysis apparatus Lusex 3 (manufactured by Nicole Co.), and analyzed. The shape factors SF-1 and SF-2 are defined in the present invention by the equations below:

$$SF\text{-}1=[(MXLNG)^2/(AREA)]\times(\pi/4)\times100$$

$$SF\text{-}2=[(PERI)^2/(AREA)]\times(1/4\pi)\times100$$

where AREA is a projection area of a toner, MXLNG is an absolute largest length, and PERI is a periphery length.

The toner shape factor SF-1 is an index for the sphericity: the value 100 showing a sphere, and a value larger than 100 showing higher deformation. The shape factor SF-2 is an index for the surface roughness: the value 100 showing no surface roughness, and a value larger than 100 showing more surface roughness of the toner.

In the present invention, the toner shape factor SF-1 is preferably in the range of from 100 to 170, more preferably from 100 to 155, still more preferably from 100 to 150, still more preferably from 100 to 145. The shape factor SF-2 is preferably in the range from 100 to 160, more preferably from 100 to 145, still more preferably from 100 to 130, still more preferably from 100 to 125. The toner of the shape factor SF-1 exceeding 170, or the shape factor SF-2 exceeding 160 tends to lower the charging ability of the magnetic brush charger as mentioned before. The toner having a nearly spherical shape shows, in addition to the above effect, high transfer efficiency in decreasing the amount of the toner entering the magnetic brush charger and to retard the deterioration of the brush, advantageously.

The process for producing the toner having the specified shape factors of the present invention includes (i) treatment for sphericity of toner particles having been produced by grinding, (ii) formation of a part or the entire of the toner by polymerization, and (iii) atomizing a molten mixture in the air by a disk or a multiple fluid nozzle to obtain spherical toner as described in Japanese Patent Publication No. 56-13945.

The treatment for sphericity of toner particles produced by grinding is conducted, for example, such that toner source materials such as a resin, a releasing agent of a low softening point, a colorant, and a charge controlling agent are uniformly dispersed by a mixer such as a Henschel mixer and a media dispersing machine, the mixture is melt-blended by a blender such as a pressure kneader and an extruder, the blended matter is allowed to collide against a target mechanically or by a jet stream to pulverize it to a desired toner particle diameter, and the pulverized matter is classified to make the particle size distribution sharp (i.e., toner particles are obtained by pulverization method), and the resulting toner particles are treated for sphericity.

The method for the treatment for sphericity of the toner particles includes pulverization by a mechanical impact type pulverizer, jet pulverization at a lower pulverization pressure with increased circulation cycles, water-bathing of dispersion of the toner in water with heating, heat treatment of the toner through hot air stream, and mechanical impact treatment of applying mechanical energy to the toner. Of these methods, mechanical impact treatment is particularly suitable.

The method of formation of a part or the entire of the toner particles by polymerization includes direct toner formation by suspension polymerization as disclosed, for example, in Japanese Patent Publication No. 36-10231, Japanese Patent Application Laid-Open Nos. 59-53856, and 59-61842; direct toner formation by dispersion polymerization by use of an organic solvent in which the monomer is soluble but the polymer is insoluble; and direct toner formation by emulsion polymerization like soap-free polymerization in the presence of water-soluble polar polymerization initiator. The toner in which at least a surface portion is formed by polymerization is preferred since the toner obtained has a nearly spherical and flat surface.

The electroconductive magnetic particles in the present invention may be made of various materials including simple electroconductive metals such as ferrite, and magnetite, and mixed crystals thereof. The material is prepared by baking electroconductive magnetic particles, and reducing or oxidizing it to adjust the electric resistance to the level described later. The electroconductive magnetic particles may be constituted of an electroconductive magnetic particles dispersed in a binder polymer produced by molding the mixture of the electroconductive magnetic particles and the binder polymer into particles, or the above particles further coated with a resin. In the latter case, the total electric resistance of the electroconductive magnetic particles can be adjusted by adjusting the resistance of the coating resin layer by controlling the content of an electroconductive agent like carbon.

The magnetic particle material employed in the present invention exhibits saturation magnetization in the range preferably from 15 to 70 $Am^2/kg$, more preferably from 40 to 60 $Am^2/kg$. The magnetic particles of saturation magnetization exceeding 70 $Am^2/kg$ exert strong magnetic confining force to form a magnetic brush of a hard ear without flexibility to result in poor contact with the photosensitive drum and failure of electrification, or significant erasion of the photosensitive drum owing to the hardness of the brush ear. The magnetic particles of saturation magnetization of less than 15 $Am^2/kg$ exert less magnetic confining force, which retards the return of the transferred magnetic particles from the photosensitive drum to the magnetic brush to cause deterioration of electrification, and adverse effects on development, image transfer, and fixation.

The saturation magnetization in the present invention was measured by a vibrating magnetometer VSM-3S-15

(manufactured by Toei Kogyo K.K.) at 1 k oersted, and the magnetization of the sample is defined as the saturation magnetization.

The magnetic particle is also preferably spherical in the present invention. Presumably this is due to the facts below. The magnetic particles having a shape nearer to a sphere can be packed more densely to result in a larger area of contact with the photosensitive member to give stable electrification. The magnetic particles of less surface roughness exhibit lubricity to the introduced toner particles to prevents fusion-bonding of the toner particles to the magnetic particle surface. Magnetic particles and toner particles in irregular shapes (apart from the sphere shape) exhibit less fluidity of the magnetic brush (containing untransferred remaining toner) on the photosensitive member to reduce the contact between the magnetic particles and the photosensitive member to lower the charging ability.

The degree of sphericity of the magnetic particles in the present invention is defined by the shape factors SF-1 and SF-2 in the same manner as in the case of the toner particles.

The magnetic particles in the present invention has a shape factor SF-1 preferably in the range from 100 to 150, more preferably from 100 to 130, still more preferably from 100 to 120, and a shape factor SF-2 preferably in the range of from 100 to 130, more preferably 100 to 115, still more preferably from 100 to 110. The magnetic particles having a shape factor SF-1 exceeding 150, or a shape factor SF-2 of exceeding 130 tend to give lower charging ability of the magnetic brush charger as mentioned above.

The magnetic particles in a nearly spherical shape exert desirably less stress uniformly to the toner particles, preventing deterioration of the toner in the magnetic brush. Such magnetic particles in a nearly spherical shape can be obtained from spherical spinel type iron oxide particles, or spherical particles of binder polymer containing electroconductive magnetic particles dispersed therein.

The magnetic particles in the present invention has a volume resistivity ranging from $1\times10^5$ to $1\times10^9$ Ω.cm, more preferably form $1\times10^6$ to $1\times10^8$ Ω.cm. The magnetic particles having a volume resistivity exceeding $1\times10^9$ Ω.cm are not capable of conducting sufficient charging to result in failure of electrification. The magnetic particles having a volume resistivity lower than $1\times10^5$ Ω.cm cause image leakage (abnormal white image in normal development, and abnormal black image in reversal development) when a pinhole is formed on the photosensitive drum.

The volume resistivity of the magnetic particles is defined in the present invention as a normalized value of a volume resistivity calculated from electric current measured such that 2 g of magnetic particles are filled in a cylindrical container having a base area of 227 $mm^2$, the magnetic particles are pressed at 6.6 $kg/cm^2$, and a voltage of 100 V is applied between the top and the bottom.

In one preferred embodiment of the present invention, two or more kinds of magnetic particles having different volume resistivity are mixedly used as magnetic particles for a magnetic brush charger.

In an image forming apparatus employing a magnetic brush charger having a constitution of recovering the remaining toner from a photosensitive member by a development device without employing a cleaner, when it is driven for a long term, a remaining toner particle introduced into the magnetic brush may adhere to magnetic particle surface to intercept a part of a carrier conduction path, or to increase the carrier resistance in low humidity conditions, thereby causing failure of electrification. To prevent this, it is effective to mix auxiliary magnetic particles having a lower volume resistivity into the main magnetic particles. The volume resistivity of the auxiliary magnetic particles to be mixed is low to cause concentration of electric current at a pinhole on the photosensitive member to give leakage and impair the image quality (stripe-shaped defect in the formed image). However, when mixed with the main magnetic particles of medium resistivity, the auxiliary magnetic particles do not cause pinhole leakage.

In mixing two or more kinds of magnetic particles of different volume resistivities, the volume resistivity of the main magnetic particles is in the range preferably from $1\times10^5$ Ω.cm to $1\times10^9$ Ω.cm, more preferably from $1\times10^6$ Ω.cm to $1\times10^8$ Ω.cm, and the volume resistivity of the auxiliary magnetic particles is preferably not less than $1\times10^0$ Ω.cm but less than $1\times10^5$ Ω.cm, more preferably not less than $6\times10^3$ Ω.cm but less than $1\times10^5$ Ω.cm.

Main magnetic particles having a volume resistivity exceeding $1\times10^9$ Ω.cm cause electrification failure, even when auxiliary magnetic particulate material having a volume resistivity ranging from not less than $1\times10^0$ Ω.cm to less than $1\times10^5$ Ω.cm is mixed thereto.

When the main magnetic particles has a volume resistivity of less than $1\times10^5$ Ω.cm, addition of the auxiliary magnetic particles having lower resistivity will cause a leakage image owing to the low resistivity at the pinhole leakage on the photosensitive drum.

Auxiliary magnetic particles having a volume resistivity exceeding $1\times10^5$ Ω.cm is not effective in combination with the main magnetic particles having a volume resistivity of from $1\times10^5$ Ω.cm to $1\times10^9$ Ω.cm. Auxiliary magnetic particles having a volume resistivity of less than $1\times10^0$ Ω.cm causes induction of electric charge therein, and adhere to the photosensitive drum by the force applied to the charge by the electric field.

The difference of the volume resistivity of the main magnetic particles from that of the auxiliary magnetic particles is preferably not less than $10^{0.5}$ Ω.cm. With the difference of less than $10^{0.5}$ Ω.cm, the effect of mixing of the auxiliary magnetic particles is low, and improvement in electrification is less remarkable.

The mixing ratio of the main magnetic particles and the auxiliary magnetic particles is preferably in the range of from 1 to 40 parts by weight, more preferably from 3 to 20 parts by weight based on 100 parts by weight of the main magnetic particles. At the mixing ratio of 40 parts by weight of the auxiliary magnetic particles based on 100 parts by weight of the main magnetic particles, an leakage image may be formed in the presence of a pin hole on the photosensitive member, whereas at the mixing ratio of the auxiliary magnetic particles of less than 1 part by weight, the effect of the mixing of the auxiliary magnetic particles is not obtained.

The respective volume resistivities of the two or more kinds of constituting magnetic particles having different volume resistivities in the mixture are measured as follows. The mixture of the magnetic particles is spread in one layer on one of a pair of metal electrode plates set in parallel. The voltage between the parallel plates is gradually raised. At a certain voltage, only lower-resistivity particles are attracted to adhere to one electrode plate. The adhering particles having a lower volume resistivity are collected, and are subjected to resistivity measurement as described before for magnetic particles. The remaining particles having a higher resistivity on the electrode plate are collected and subjected to volume resistivity measurement.

For electrification of an image holding member by a magnetic brush charger, in the present invention, a DC voltage is applied as the charging bias. In a preferred embodiment, an AC component is superposed on the DC voltage.

The applied AC component vibrates the magnetic particles to facilitate the introduced remaining toner to enter effectively the interspace of the magnetic particles to give stable electrification.

The superposition of an AC component in electrification is effective in use of a nonmagnetic toner as the development toner. The nonmagnetic toner, which has generally a high resistivity, can be electrically charged in a larger electric charge quantity for unit area as compared with a magnetic toner. Therefore, the nonmagnetic toner particles remaining after image transfer is attracted strongly by the photosensitive member and are not readily separated therefrom in comparison with magnetic toner particles. The superposed AC component in the applied voltage for electrification vibrates the charging magnetic brush to weaken the attraction of the remaining toner to the photosensitive member and to facilitate recovery of the remaining toner by the magnetic brush.

The AC voltage applied as electrification bias to a magnetic brush charger in the present invention may be of a sine wave, a rectangle wave, and so forth. A rectangle wave is preferred in view of effective release of the toner particles from the magnetic brush.

The AC component has a frequency ranging preferably from 400 to 4000 Hz, more preferably from 500 to 2000 Hz, and an amplitude ranging from 200 to 2000 Vpp, more preferably from 400 to 1500 Vpp. The AC component having a frequency exceeding 4000 Hz does not produce sufficiently the effect of AC application without improvement from simple DC application. The AC component having a frequency of less than 400 Hz releases toner particles in correspondence with the frequency to cause fogging, irregularity and the like defects of images. At the amplitude of the AC component exceeding 2000 Vpp, the electrified magnetic particles having induced electric charge are driven by the action of the electric field and tend to adhere to the photosensitive drum. At the amplitude of the AC component of less than 200 Vpp, the effect of the AC is insufficient with little improvement in electrification.

The DC voltage of the electrification bias applied to the magnetic brush charger is preferably in the range from −300 V to −1000 V for obtaining usual electrification potential of the photosensitive drum, in the present invention.

The image holding member useful in the present invention may be the one constituted of an electroconductive substrate, a photosensitive layer formed thereon composed of a material such as an organic photoconductor (OPC), ZnO, selenium, and amorphous silicon, and an electric charge injection layer formed as the outermost layer on the photosensitive layer.

The electric charge injection layer is constituted preferably of 100 parts by weight of a binder resin such as a photosetting acrylic resin for binding electroconductive fine particles and 20 to 100 parts by weight of electroconductive fine particles dispersed in the binder resin. The electroconductive fine particles may be made of a material such as $SnO_2$, $TiO_2$, and ITO, having an average particle diameter preferably not more than 1 $\mu$m, more preferably in the range from 0.5 to 50 nm for uniform electrification.

The average particle diameter of the electroconductive fine particles in the present invention was measured by selecting 100 or more particles at random in scanning electron microscopy, calculating volume-particle size distribution from the maximum chord lengths of the particles in horizontal direction, and taking 50% average particle diameter.

The resin for binding the electroconductive fine particles includes transparent resins such as acrylic resins, polycarbonate resins, polyester resins, polyethylene terephthalate resins, and polystyrene resins. For improvement of lubricity of the photosensitive drum surface, a lubricating material such as teflon may be incorporated into the charge injection layer. For film formation, a crosslinking agent, or a polymerization initiator may be added to the resin in an appropriate amount. The charge injection layer is provided intentionally as the injection site for electrifying uniformly the surface by directly injecting the electric charge from the magnetic brush charger 2, and has a resistivity preferably not more than $1\times10^{14}$ Ω.cm, more preferably from $1\times10^{9}$ to $1\times10^{14}$ Ω.cm, still more preferably from $1\times10^{11}$ to $1\times10^{14}$ Ω.cm for preventing the flow of the latent image charge along the surface. With the charge injection layer having a volume resistivity of higher than $1\times10^{14}$ Ω.cm, uniform injection charging is not practicable, whereas with the charge injection layer having lower volume resistivity, the electrostatic latent image cannot be held perfectly to result in blurring of the image.

The resistivity of the charge injection layer in the present invention was obtained by measuring surface resistance of a charge injection layer applied on an insulating sheet by mean of a high resistance tester 4329A manufactured by HP Co. at voltage application of 100 V.

The OPC photosensitive layer for the image holding member in the present invention may be a function separation type OPC photosensitive member constituted of a subbing layer as the first layer, a positive charge injection preventing layer as the second layer, a charge-generating layer as the third layer, and a charge-transporting layer as the fourth layer laminated in the named order on an aluminum substrate as an electroconductive substrate, or may be a single layer type OPC photosensitive member.

The charge injection layer formed on the photosensitive layer contains preferably lubricating particles such as fluoroplastic resin particles, and silicone resin particles. The lubricating particles are preferably contained in an amount ranging from 5 200 parts by weight based on 100 parts by weight of the binder resin for the electroconductive fine particles.

The development apparatus applicable to the present invention is described below in detail by reference to drawings.

The development system of the development apparatus in the present invention may be a contact development system in which development is conducted by contact of a developer carried by a carrier with a surface of a photosensitive member in the development area; or may be a non-contact jumping development system in which development is conducted by keeping a layer of a developer carried by a carrier apart from a surface of a photosensitive member in the development area and allowing the developer to fly from a developer carrying member. Of these, contact development system is preferred in view of simultaneous development and cleaning.

The contact development system includes a system employing a two-component developer comprising a toner and a carrier, and another system employing a one-component developer. In the case where the development device also serves as the cleaning means for cleaning a remaining toner on a photosensitive member after toner image transfer, the contact development system is preferred in the present invention because of a high ratio of recovery of the remaining toner in comparison with the non-contact development system.

Figure 6:
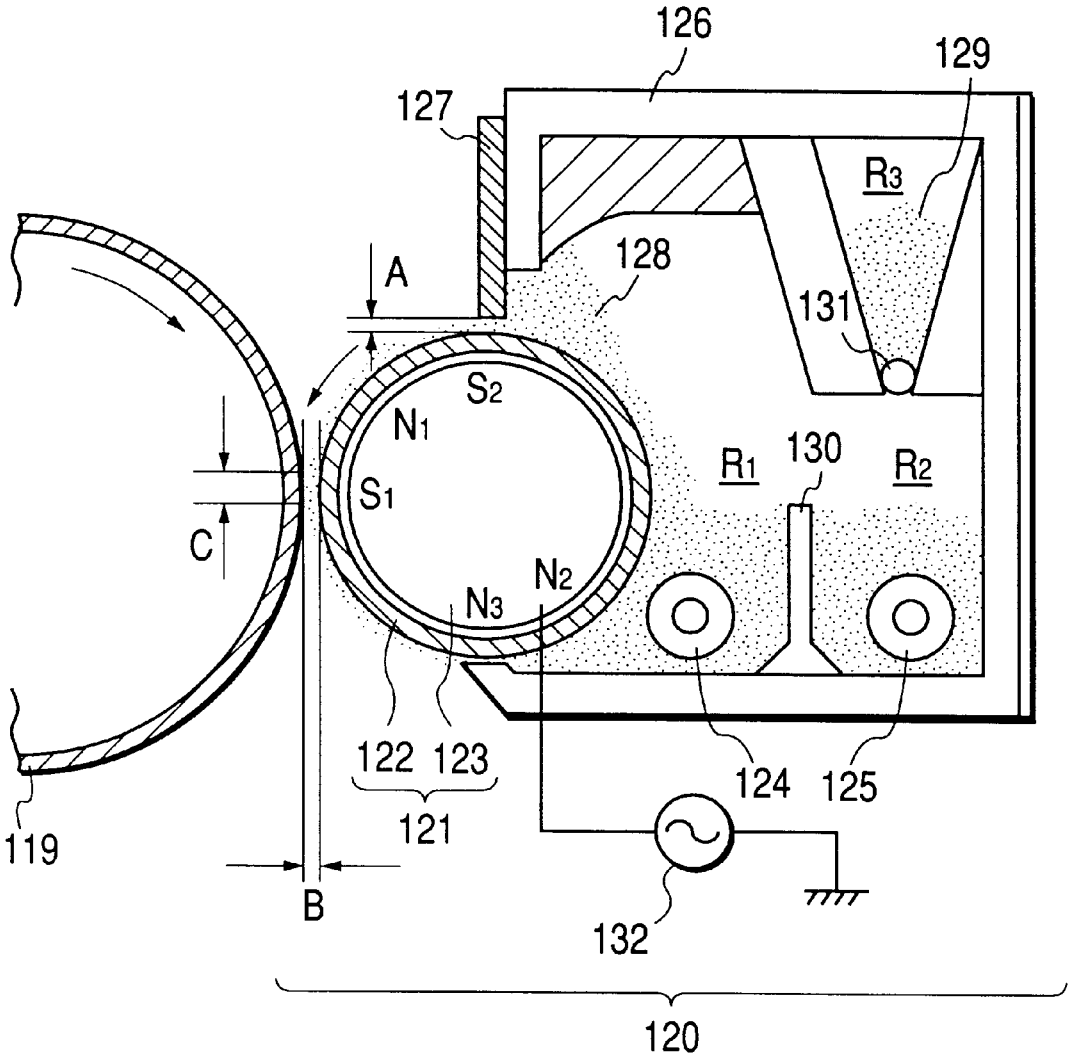
FIG. 6 illustrates schematically a constitution of a development device of contacting two-component type development system.

The two-component contact development can be conducted by use of a two-component developer containing a toner and a magnetic carrier by means of a development apparatus 120 shown in FIG. 6.

The development apparatus 120 comprises a development vessel 126 for storing a two-component developer 128, a development sleeve 121 as a developer carrier for carrying the two-component developer 128 from the development vessel 126 to the development region, and a development blade 127 as the developer layer thickness controlling means for controlling the thickness of the developer layer formed on the development sleeve 121.

The development sleeve 121 is constituted of a nonmagnetic sleeve base 122, and a magnet 123 enclosed therein.

The interior of the development vessel 126 is partitioned by a partitioning wall 130 into a development room (First room) $R_1$ and an agitation room (second room) $R_2$. Above the agitation room $R_2$, a toner storage room $R_3$ is provided by the partitioning wall 130. A developer 128 is held in the development room $R_1$ and the agitation room $R_2$, and a replenishing toner (nonmagnetic toner) 129 is held in the toner storage room $R_3$. A replenishing opening 131 is provided for the toner storage room $R_3$ for supplying the replenishing toner 129 to the agitation room $R_2$ by gravity.

A delivery screw 124 is provided in the development room $R_1$. The delivery screw 124 delivers the developer 128 in the development room $R_1$ in the length direction by rotation. Similarly, a delivery screw 125 is provided in the agitation room $R_2$ to deliver the toner supplied for the replenishing opening 131 to the length direction of the development sleeve 121.

The developer 128 is a two-component developer comprising a nonmagnetic toner and a magnetic carrier.

At the portion near the photosensitive drum 119 of the development vessel 126, an opening is provided. The development sleeve 121 protrudes through the opening. A certain gap is provided between the development sleeve 121 and the photosensitive drum 119. A bias-applying means 132 for applying a bias is connected to the development sleeve 121 formed from a nonmagnetic material.

The magnet roller, namely the magnet 123 as a magnetic field-generating means fixed in the sleeve base 122, has a development magnetic pole $S_1$, a magnetic pole $N_3$ placed in the downstream side, and magnetic poles $N_2$, $S_2$ and $N_1$ for delivering the developer 128. The magnet 123 is placed in the sleeve base 122 with the development magnetic pole $S_1$ opposing to the photosensitive drum 119. The development magnetic pole $S_1$ generates a magnetic field in the vicinity to the development region between the development sleeve 121 and the photosensitive drum 119 to form a magnetic brush by the magnetic field.

The developer layer thickness controlling blade 127, which is placed above the development sleeve 121 to control the layer thickness of the developer 128 on the development sleeve 121, is made from a nonmagnetic material such as aluminum, and SUS316. The gap A between the end of the nonmagnetic blade 127 and the face of the development sleeve 121 is in the range from 300 to 1000 $\mu$m, preferably from 400 to 900 $\mu$m. With the gap A smaller than 300 $\mu$m, the magnetic carrier is liable to clog the gap to make the developer layer irregular, and to reduce supply of the developer for the development to result in formation of thin and irregular images, disadvantageously. To prevent nonuniform application (so-called blade blocking) by unnecessary particles in the developer, the gap is preferably larger than 400 $\mu$m. With the gap A larger than 1000 $\mu$m, the amount of the developer applied to the development sleeve 121 is increased and the developer layer thickness cannot be controlled as desired. Thereby, a larger amount of magnetic carrier particles deposits onto the photosensitive drum 119, and the control blade 127 cannot control effectively the circulation of the developer, resulting in fogging owing to insufficient triboelectricity.

The development by the two-component system development apparatus 120 is conducted by applying an alternate electric field by bringing a magnetic brush constituted of a toner and a magnetic carrier into contact with an image holding member 119 (e.g., a photosensitive drum). By the contact of the magnetic brush with the image holding member, the remaining toner after the toner image transfer is taken up by the magnetic brush and is recovered into a development room $R_1$. The gap B between the developer holding member (development sleeve) 121 and the photosensitive drum 119 (S-D distance) is preferably ranges from 100 to 1000 $\mu$m for prevention of carrier sticking and improvement of dot reproducibility. With the gap smaller than 100 $\mu$m, the feed of the developer is liable to be insufficient to lower the image density, whereas with the gap of larger than 1000 $\mu$m, the magnetic lines from the Magnet S1 is dispersed to lower the density of the magnetic brush, causing poor dot reproducibility, and carrier adhesion owing to low restriction of the carrier.

The voltage between the peaks of the alternate electric field is preferably in the range from 500 to 5000 V, and the frequency thereof is in the range from 500 to 10000 Hz, preferably from 500 to 3000 Hz depending on the process. The wave shape may be selected from triangle waves, rectangle waves, sine waves, and waves of various duty ratios. At voltage application of lower than 500 V, the image density tends to be low and a fogging toner at a non-image portion cannot surely be recovered, causing low image quality. At voltage application exceeding 5000 V, the electrostatic image tends to be disturbed through the magnetic brush to lower the image quality.

By use of a two-component developer appropriately electrified, the fog-removal voltage (Vback) can be lowered and the primary charging of the photosensitive member can be lowered to lengthen the life of the photosensitive member. Vback is preferably not higher than 150 V, more preferably not higher than 100 V depending on the development system.

The contrast potential is preferably in the range of from 200 to 500 V for sufficient image density.

At the frequency lower than 500 Hz, charge injection to the carrier tends to occur to cause carrier adhesion, and latent image disturbance, lowering the image quality depending on a process speed. At the frequency higher than 10000 Hz, the toner cannot follow the electric field, tending to cause lower image quality.

For sufficient image density, high dot reproducibility, and no carrier adhesion in development, the contact breadth (development nip C) of the magnetic brush on the development sleeve 121 with the photosensitive drum 119 is preferably in the range from 3 to 8 mm. With the development nip C of less 3 mm, neither sufficient image density nor sufficient dot reproducibility can be achieved, whereas with the development nip C of more than 8 mm, the developer may be packed to stop the function of the machine, or the carrier adhesion may not be prevented effectively. The development nip can be adjusted by adjusting the distance A between a developer controlling member 127 and the development sleeve 121, or by adjusting the distance B between the development sleeve 121 and the photosensitive drum 119.

Figure 7:
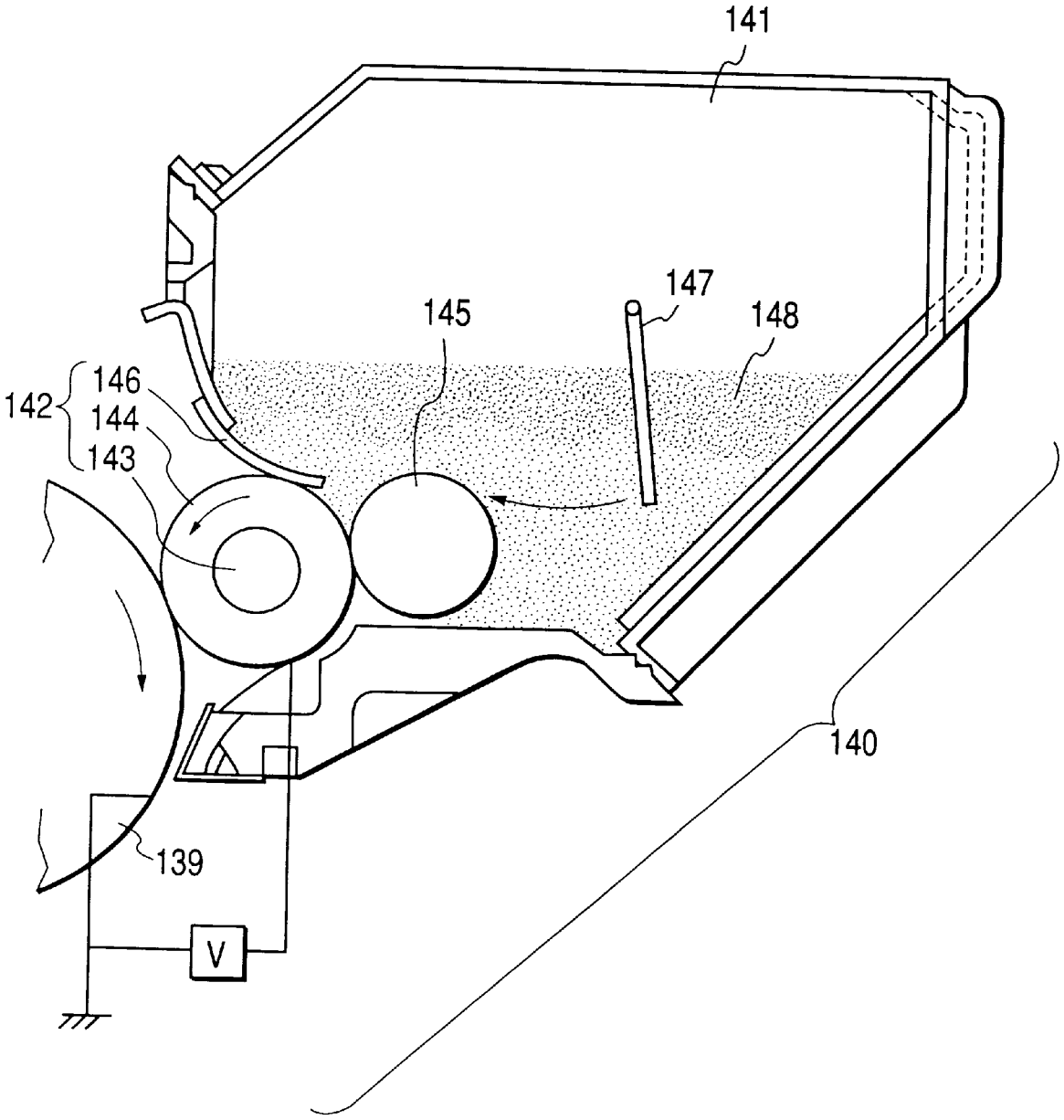
FIG. 7 illustrates schematically a constitution of a development device of contacting one-component type development system.

The one-component contact development can be conducted either with a magnetic toner or with nonmagnetic toner by use, for example, of a development apparatus 140 shown in FIG. 7.

The development apparatus 140 comprises a development vessel 141 for storing a magnetic toner or nonmagnetic toner as the one-component developer 148, a developer holding member 142 for holding the one-component developer 148 stored in development vessel 141 and delivering it to a development region, a feeding roller 145 for feeding the developer onto the developer holding member 142, an elastic blade 146 as a developer layer thickness controlling member for controlling the developer layer thickness on the developer holding member, and an agitating member 147 for agitating the developer 148 in the development vessel 147.

The developer holding member 142 is preferably constituted of a roller base 143, and an elastic layer 144 formed from an elastic material of rubber or a resin such as a foamed silicone rubber. This elastic roller 142 is brought into pressure contact with the surface of a photosensitive drum 139 as an image holding member, develops an electrostatic latent image formed on the photosensitive member with the one-component developer 148 applied on the surface of the elastic roller, and after the toner image transfer, recovers the untransferred one-component developer 148 from the photosensitive member.

In one-component contact development, in the present invention, the developer holding member is substantially in contact with the photosensitive member surface. In other words, even in the absence of the one-component developer, the developer holding member is in contact with the photosensitive member. Thereby, the electric field generated through the developer between the photosensitive member and the developer holding member enables formation of an image without an edge effect and simultaneous cleaning of the photosensitive member. The surface of the elastic roller as the developer holding member and the vicinity of the surface should have a potential to generate an electric field between the surface of the photosensitive member and the surface of the elastic roller. For the electric field generation, various method can be employed. In one method, the elastic rubber of the elastic roller is made to have a medium resistance so as to limit electric conduction to the photosensitive member and to maintain thereby the electric field. In another method, a thin dielectric layer is provided on the surface layer of the electroconductive roller. In a still another method, a sleeve of an electroconductive resin is provided on the electroconductive roller, and the sleeve is coated with an insulating material at the face contacting with the photosensitive member surface, or an insulating sleeve is provided and the face thereof not contacting with the photosensitive member is covered with an electroconductive layer.

The elastic roller holding the one-component developer may be rotated in the same direction as the photosensitive drum, or in the reverse direction thereof. When the elastic roller is rotated in the same direction, the ratio of the peripheral speed of the elastic roller to that of the photosensitive drum is preferably higher than 100%. At the ratio not higher than 100%, the image quality such as line sharpness is liable to be impaired. At the higher peripheral speed ratio, a larger amount of developer is fed to the development section, frequency of attaching and detaching of the developer to the electrostatic latent image is larger, and more precise latent image can be obtained by deposition of the developer on a necessary portion and scraping of the unnecessary developer. More preferably, the peripheral speed ratio is higher than 110%. From the standpoint of the simultaneous development and cleaning, a higher peripheral speed ratio of the elastic roller to the photosensitive drum is preferred for better recovery of the developer, since the remaining developer after image transfer can be physically scraped from the surface of the photosensitive member by the peripheral speed difference and can be recovered by the electric field effectively.

The developer layer thickness controlling member 146 is not limited to the elastic blade, but may be any material which can be pressed by elastic force against the surface of the developer holding member 142. An elastic roller may be used in place of the elastic blade.

The elastic blade or the elastic roller may be constituted of an elastic rubber such as silicone rubbers, urethane rubbers, and NBR; an elastic synthetic resin such as polyethylene terephthalate; or an elastic metal such as stainless steel, and steel, or composite material thereof.

The elastic blade is fixed at the upper end side to the development vessel, and is pressed against the sleeve surface with elasticity of the blade in a distorted state in a normal or reverse direction at the inside blade face (or outside blade face in reverse direction).

The feeding roller 145 is constructed from a foamed material such as polyurethane foams. It rotates in a normal or reverse direction at a certain speed relative to the developer holding member, feeding the one-component developer and scraping the developer (not used for development) after the development.

In development of the electrostatic latent image on the photosensitive member with the one-component developer on the developer holding member in the development section, an AC and/or DC bias is preferably applied between the developer holding member and the photosensitive drum.

The non-contact jumping development system is explained below.

The non-contact jumping development system includes a development system employing a one-component magnetic developer containing a magnetic toner, and a development system employing a one-component nonmagnetic developer containing a nonmagnetic toner.

The development system employing a one-component magnetic developer as the magnetic toner is described by reference to a schematic drawing of FIG. 8.

A development apparatus 150 comprises a development vessel 151 for storing the one-component magnetic developer 155 as a magnetic toner, a developer holding member 152 for holding the one-component magnetic developer 155 stored in development vessel 151 and delivering it to a development region, a doctor blade 154 as a developer layer thickness controlling member for controlling the developer layer thickness on the developer holding member, and an agitating member 156 for agitating the one-component magnetic developer 155 in the development vessel 151.

Figure 8:
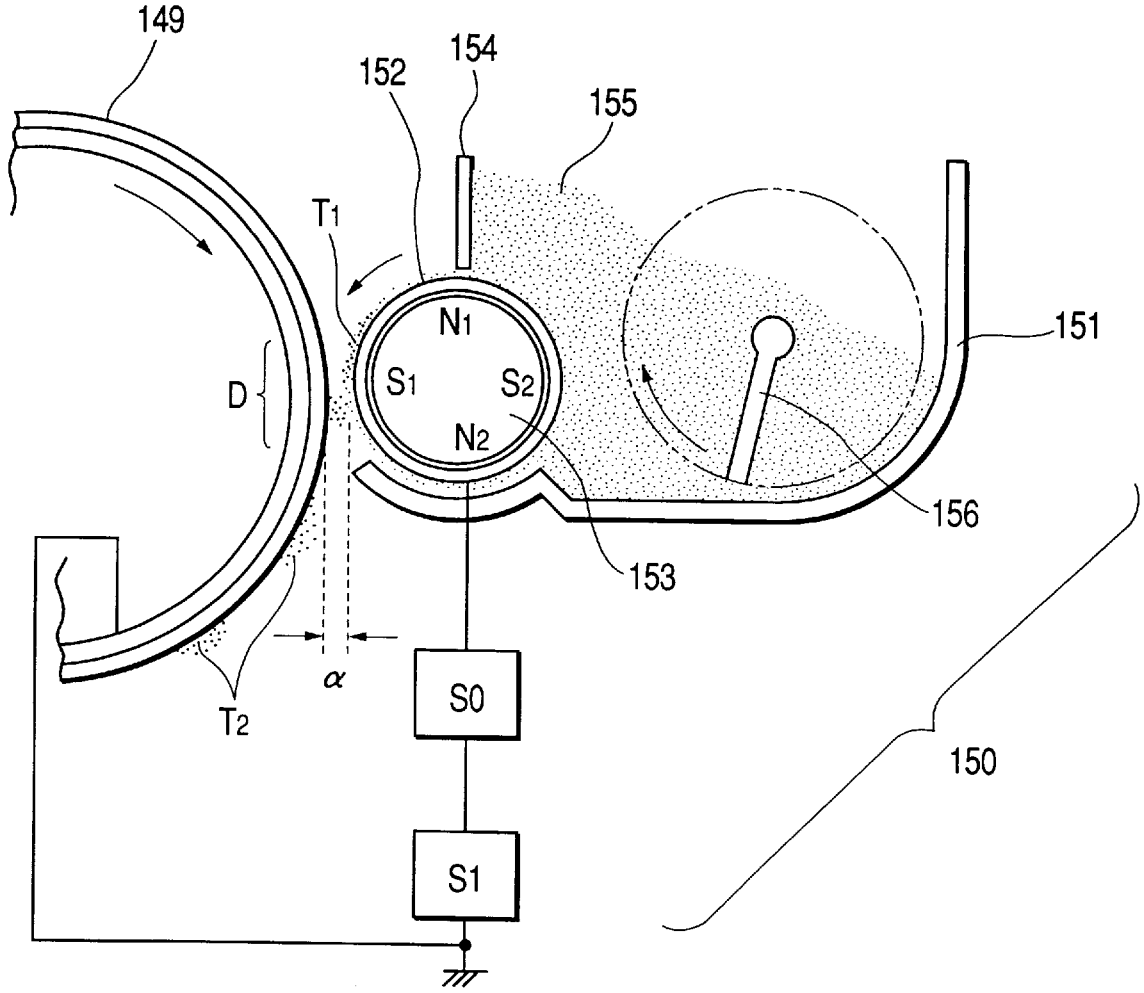
FIG. 8 illustrates schematically a constitution of a development device of non-contacting one-component type magnetic development system.

In FIG. 8, the nearly right-half face of a development sleeve 152, developer holding member, is in continuous contact with the developer stock in a developer vessel 151. The one-component magnetic developer near the development sleeve surface is attracted and held by the surface of the development sleeve by magnetic force generated by a magnetization means 153 in the sleeve and/or by electrostatic force. With rotation of the development sleeve 152, a thin layer $T_1$ of the one-component magnetic developer is formed during passage through the position of the doctor blade 154 on the sleeve surface approximately in a uniform thickness. The electrification of the one-component magnetic developer is caused mainly by frictional contact of the sleeve surface with the one-component magnetic developer of the developer stock near the sleeve resulting from the rotation of the development sleeve 152. With rotation of the development sleeve, the thin layer of the one-component magnetic developer on the development sleeve 152 moves to the side of the image holding member 149 to pass the development region D where the image holding member 149 and the development sleeve 152 come closest together. During the passage, the one-component magnetic developer in the thin layer thereof on the development sleeve 152 is allowed to fly reciprocatingly between the development region of the latent image holding member 149 and the face of the development sleeve 152 (gap $\alpha$) by the electric field generated by DC voltage and AC voltage applied therebetween. Finally, the one-component magnetic developer is selectively transferred in accordance with the potential pattern of the electrostatic latent image from the development sleeve 152 to the image holding member 149 to form a developer image $T_2$ successively.

After the passage through the development region D, the surface of the development sleeve having the one-component magnetic developer selectively consumed is moved by rotation to the developer stock in the development vessel 151, and receives supply of the one-component magnetic developer. The thin layer $T_1$ of the one-component magnetic developer on the development sleeve 152 is delivered again to the development region D for subsequent development.

The doctor blade as the developer layer thickness controlling member is a metal blade or a magnetic blade placed with a gap close to the development sleeve as shown 154 in FIG. 8. In the one-component development system such as a magnetic one-component development system and nonmagnetic one-component development system, as the developer layer thickness controlling member, the elastic blade is employed which is brought into contact with the development sleeve surface by elastic force. An elastic roller may be used in place of the doctor blade.

The elastic blade or the elastic roller may be constituted of an elastic rubber such as silicone rubbers, urethane rubbers, and NBR; an elastic synthetic resin such as polyethylene terephthalate; or an elastic metal such as stainless steel, and steel, or composite material thereof. Of these, elastic rubbers are preferred.

Figure 9:
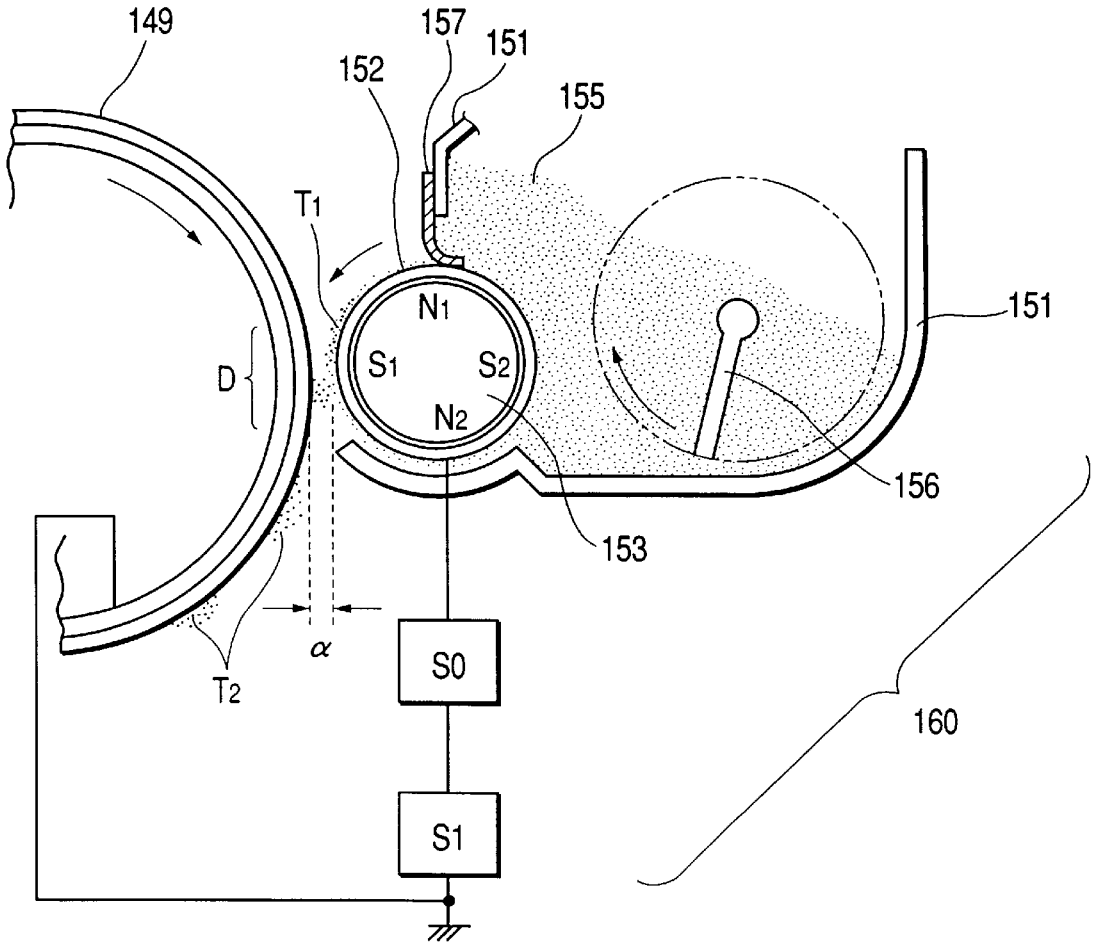
FIG. 9 illustrates schematically a development device employing an elastic blade in place of the development agent layer thickness controlling means in the development device in FIG. 8.

FIG. 9 shows schematically the constitution of a development apparatus 160 which has a blade 157, as the developer layer thickness controlling member, fixed to a development vessel 151 and brought into pressure contact at the other end with a developer holding member 152 in place of the doctor blade 154 in the development vessel 150 shown in FIG. 8.

In FIG. 9, the same numerals and symbols as in FIG. 8 are used for indicating the same constitutional member. An elastic blade 157, developer layer thickness controlling member, is fixed at the upper base side to a development vessel 151, and is pressed against the sleeve surface with elasticity of the blade in a distorted state in a direction normal or reverse to the development sleeve 152 at the inside blade face (or outside blade face in reverse direction). With such an apparatus, a thin and dense toner layer can be obtained stably regardless of environmental conditions. Presumably, the developer is subjected forcibly to friction by the elastic blade 157 and the development sleeve 152 to be electrified invariably in a constant state irrespectively of the environmental change, in comparison with the apparatus in which conventional metal blade is placed close to the development sleeve with a certain gap. Although such an apparatus is liable to cause excessive electrification and to give rise to fusion of the toner on the development sleeve and the blade, the toner of the present invention can be used suitably since it has excellent fluidity.

In the magnetic one-component development system, the elastic blade is pressed against the development sleeve at a line pressure of 0.1 kg/m, or higher, preferably in the range from 0.3 to 25 kg/m, more preferably from 0.5 to 12 kg/m on the generatrix line of the development sleeve. At the contact pressure lower than 0.1 kg/m, the developer comes to be applied nonuniformly to give broad distribution of the electric charge to cause fogging of the image or scattering of the toner. At the contact pressure higher than 25 kg/m, a higher pressure applied to the developer will deteriorate the developer to cause aggregation of the developer, and requires a larger torque for driving the developer holding member disadvantageously.

The gap $\alpha$ between the latent image holding member and the developer holding member is adjusted in the range, for example, from 50 to 500 $\mu$m in the present invention. When a magnetic blade is employed as the developer layer thickness controlling member, the gap between the magnetic blade and the developer holding member is preferably adjusted in the range from 50 to 400 $\mu$m.

The thickness of the layer of the magnetic one-component developer on the developer holding member is preferably smaller than the gap $\alpha$ between the latent image holding member and the developer holding member. However, in some cases, the layer thickness may be controlled such that a part of many ears of the magnetic one-component developer constituting the magnetic one-component developer layer are brought into contact with the electrostatic latent image holding member.

The development sleeve is rotated at a peripheral speed of 100% to 200% relative to the latent image holding member. The alternate bias voltage of peak-to-peak is not less than 0.1 kV, preferably in the range from 0.2 to 3.0 kV, more preferably from 0.3 to 2.0 kV. The alternate bias frequency is in the range from 1.0 to 5.0 kHz, preferably from 1.0 to 3.0 kHz, more preferably from 1.5 to 3.0 kHz. The waveform of the alternate bias may be a rectangle, a sine wave, a saw-teeth wave, triangle wave, and so forth. An asymmetric alternate bias having different positive and negative voltage and application times may be used. A DC bias is preferably superposed.

Figure 10:
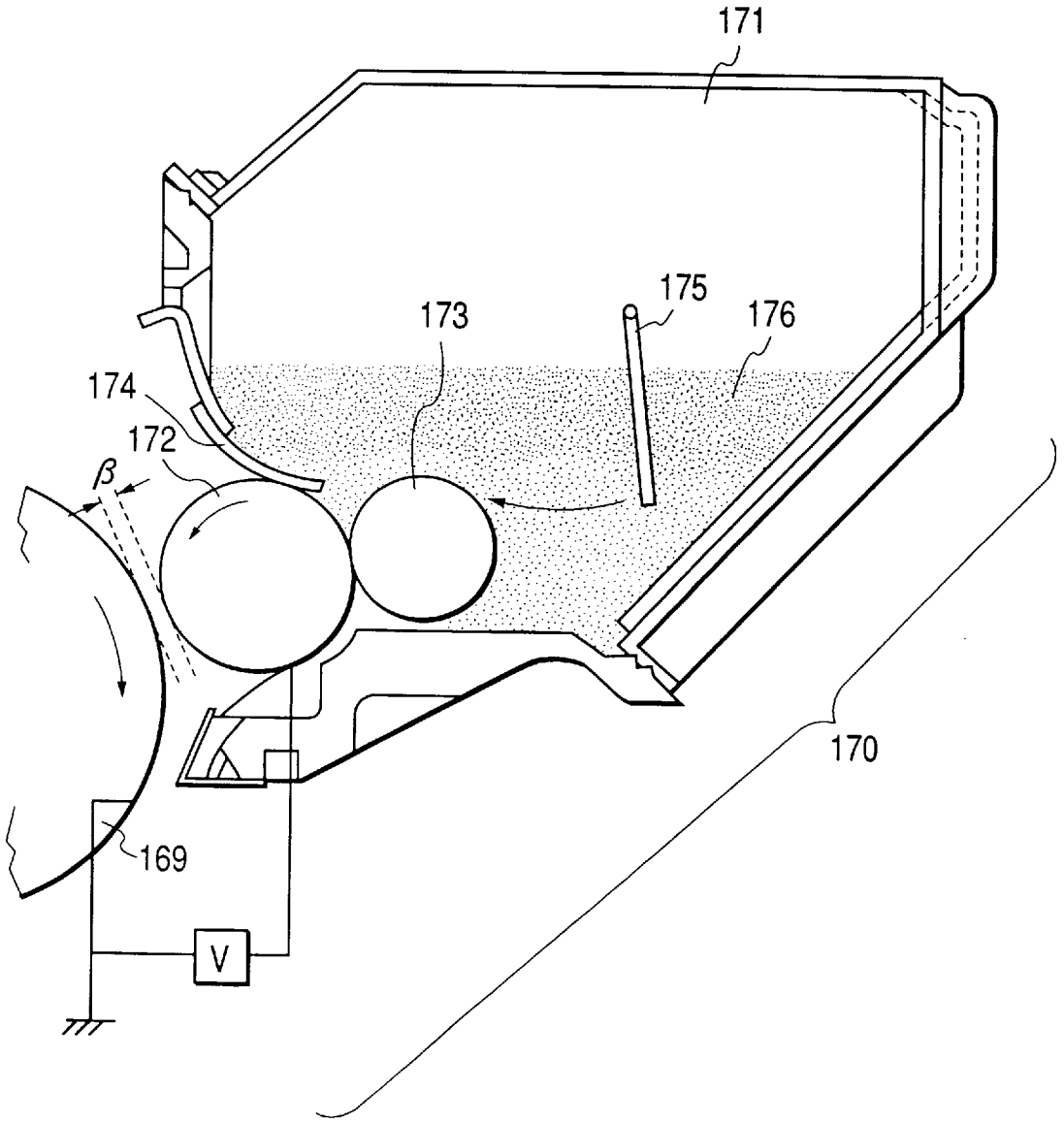
FIG. 10 illustrates schematically a constitution of a development device of non-contacting one-component type non-magnetic development device.

The development system with a one-component nonmagnetic developer containing a nonmagnetic toner is described below by reference to FIG. 10 showing schematically the construction of the apparatus.

A development apparatus 170 comprises a development vessel 171 for storing a nonmagnetic one-component developer 176 as the nonmagnetic toner, a developer holding member 172 for holding the one-component nonmagnetic developer 176 stored in the development vessel 171 and delivering it to a development region, a feed roller 173 for feeding the one-component nonmagnetic developer onto the developer holder, an elastic blade 174 as a developer layer thickness controlling member for controlling the developer layer thickness on the developer holding member, and an agitating member 175 for agitating the one-component nonmagnetic developer 176 in the development vessel 171.

The numeral 169 indicates an image holding member for holding an electrostatic latent image. The latent image is formed by an electrophotographic process means, or an electrostatic recording means not shown in the drawing. A development sleeve 172 as the developer holding member is made from a nonmagnetic material such as aluminum, and stainless steel. The development sleeve may be a crude tube of aluminum or stainless steel, but is preferably a tube having a rough surface blasted uniformly with glass beads, a mirror-polished tube, or a tube coated with a resin.

The one-component nonmagnetic developer 176, which is stored in the development vessel 171, is fed by the feed roller 173 to the developer holding member 172. The feed roller 173 is constituted of a foamed material like a polyurethane foam, and is rotated at a speed of not zero relative to the developer holding member in a normal or reverse direction to feed the developer to the developer holding member 172 and to scrape the developer (not used for development) after the development therefrom. The one-component nonmagnetic developer fed to the developer holding member 172 is applied in a uniform thin film by the elastic blade 174 as the developer layer thickness controlling member.

The elastic application blade is pressed against the development sleeve at a line pressure in the range from 0.3 to 25 kg/m, preferably from 0.5 to 12 kg/m in the generatrix direction of the development sleeve. At the contact pressure lower than 0.3 kg/m, the one-component nonmagnetic developer comes to be applied nonuniformly to give broad distribution of the electric charge to cause fogging of the image or scattering of the toner. At the contact pressure higher than 25 kg/m, a higher pressure applied to the one-component nonmagnetic developer will deteriorate the one-component nonmagnetic developer to cause aggregation of the one-component nonmagnetic developer, and requires a larger torque for driving the developer holding member disadvantageously. At the contact pressure of from 0.3 to 25 kg/m, the aggregate of the one-component nonmagnetic developer can be effectively disintegrated, and the electric charge of the one-component nonmagnetic developer can be raised instantaneously.

The developer layer thickness controlling member is similar to the one employed in the non-contact one-component magnetic development system shown in FIG. 8. The elastic blade, or the elastic roller is preferably made from a material of the suitable frictional electrification rank for electrifying the developer to a desired polarity, and is similar to the one employed in the non-contact one-component magnetic development system shown in FIG. 8.

In this development with a one-component nonmagnetic developer, in the system of coating of the thin layer of one-component nonmagnetic developer on a development sleeve by a blade, the thickness of the one-component nonmagnetic developer on the development sleeve is preferably adjusted to be less than the opposing gap β between the development sleeve and the latent image holding member, and alternate electric field is applied to the gap in order to obtain sufficient image density. Specifically, a development bias of AC electric field or a superposition of AC and DC electric field is applied between the development sleeve 172 and the image holding member 169 by a bias voltage source shown in FIG. 10 to facilitate the movement of the one-component nonmagnetic developer from the developer sleeve onto the image holding member to obtain an image of higher quality. The conditions are similar to those of the non-contacting one-component nonmagnetic development method shown in FIG. 8.

The transfer roller 4 employed as the transfer means in the present invention is constituted of a core metal and a medium-resistivity foam layer provided thereon. For electrostatic transfer, a transfer voltage ranging from 500 V to 4 kV is preferably applied to the core metal of the transfer roller 4.

The above transfer roller has preferably a volume resistivity ranging preferably from $10^6$ to $10^{10}$ Ω.cm under application of 2000 V in view of the transfer characteristics under various environmental conditions for various image patterns.

As the transfer means, in place of the transfer roller 4 shown in FIG. 1, a transfer blade in a shape of a blade, as the contact transfer means, may be used which is brought into contact with a transfer-receiving medium P from the reverse side thereof (including the contact at the reverse side by aid of a supporter for the transfer-receiving medium like a transfer belt) and transfers a toner image by electrostatic force and a slight pressure by application of a transfer voltage.

In place of the above contact electrification means, a non-contact transfer means is applicable which transfer a toner image by electrostatic force by application of a transfer voltage from a conventional corona charger placed apart at the back side of the transfer-receiving medium. However, the contact transfer means is preferred to avoid ozone generation during the transfer voltage application.

Figure 12:
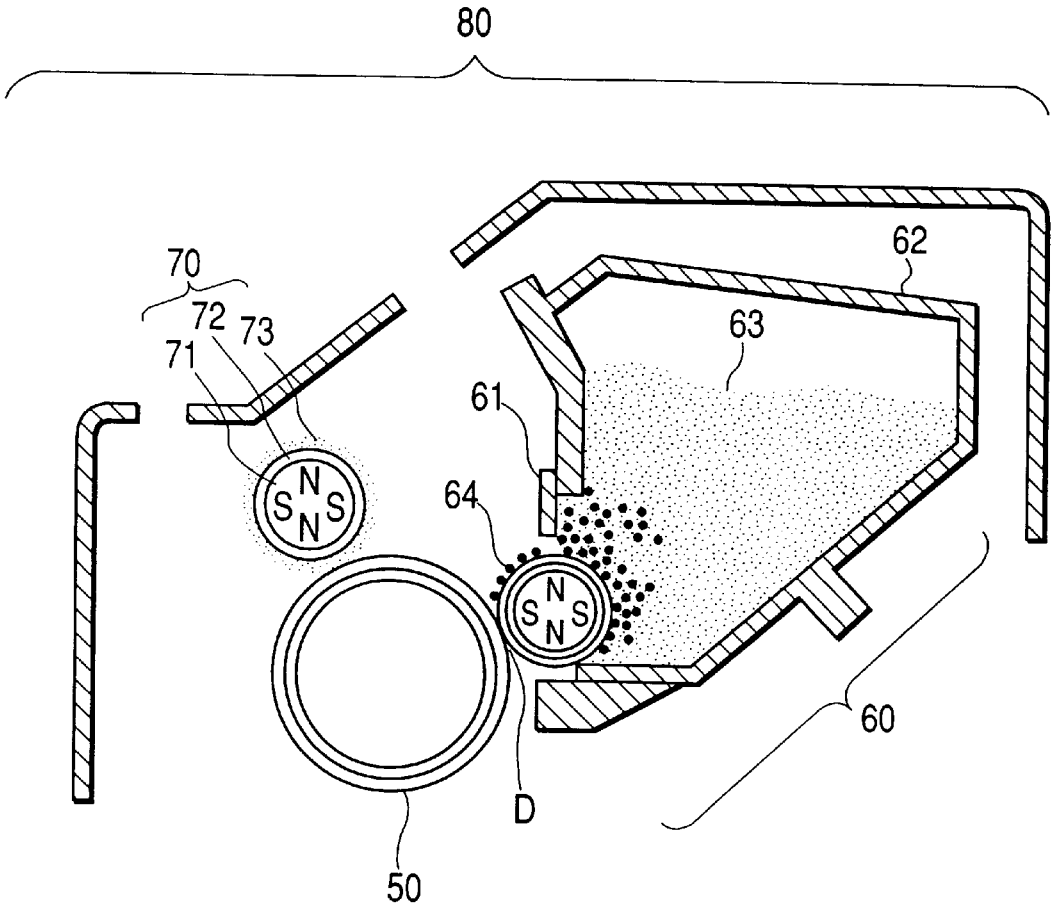
FIG. 12 illustrates schematically the constitution of a process cartridge of the present invention.

FIG. 12 shows a specific example of the process cartridge of the present invention.

The process cartridge of the present invention comprises at least a development apparatus as the developing means, an electrostatic image holder for holding an electrostatic latent image, and a magnetic brush charger for a primary charging means integrated into a cartridge, and is mounted demountably to a main assembly of an image formation apparatus (for example, copying machines, laser beam printers, and facsimile machines). FIG. 12 shows a process cartridge 80 of an embodiment of the present invention having a development device 60 as the developing means, an image holding member (photosensitive drum) 50 having a drum shape, a magnetic brush charger 70 as the primary charging means integrated into one body. The magnetic brush charger 70 comprises a charging sleeve 72, a magnet 71 enclosed therein, and a magnetic brush formed by confining magnetic particles 73 by magnetic force of the magnet 71. In this embodiment, a development apparatus 60 has a magnetic control blade 61, developer vessel 62, and a two-component developer 63 composed of a toner and a magnetic carrier stored in the developer vessel 62. In this apparatus, development is conducted with the toner of the two-component developer 63 by producing a prescribed electric field between the photosensitive drum 50 and the development sleeve 64 by the development bias voltage from a bias application means.

In the above embodiment, three constituting members, namely the development apparatus 60, the image holding member 50, and the primary charging means 70, are integrated into a cartridge. However, in the present invention, another constituting member may be incorporated additionally into the cartridge.

Figure 13:
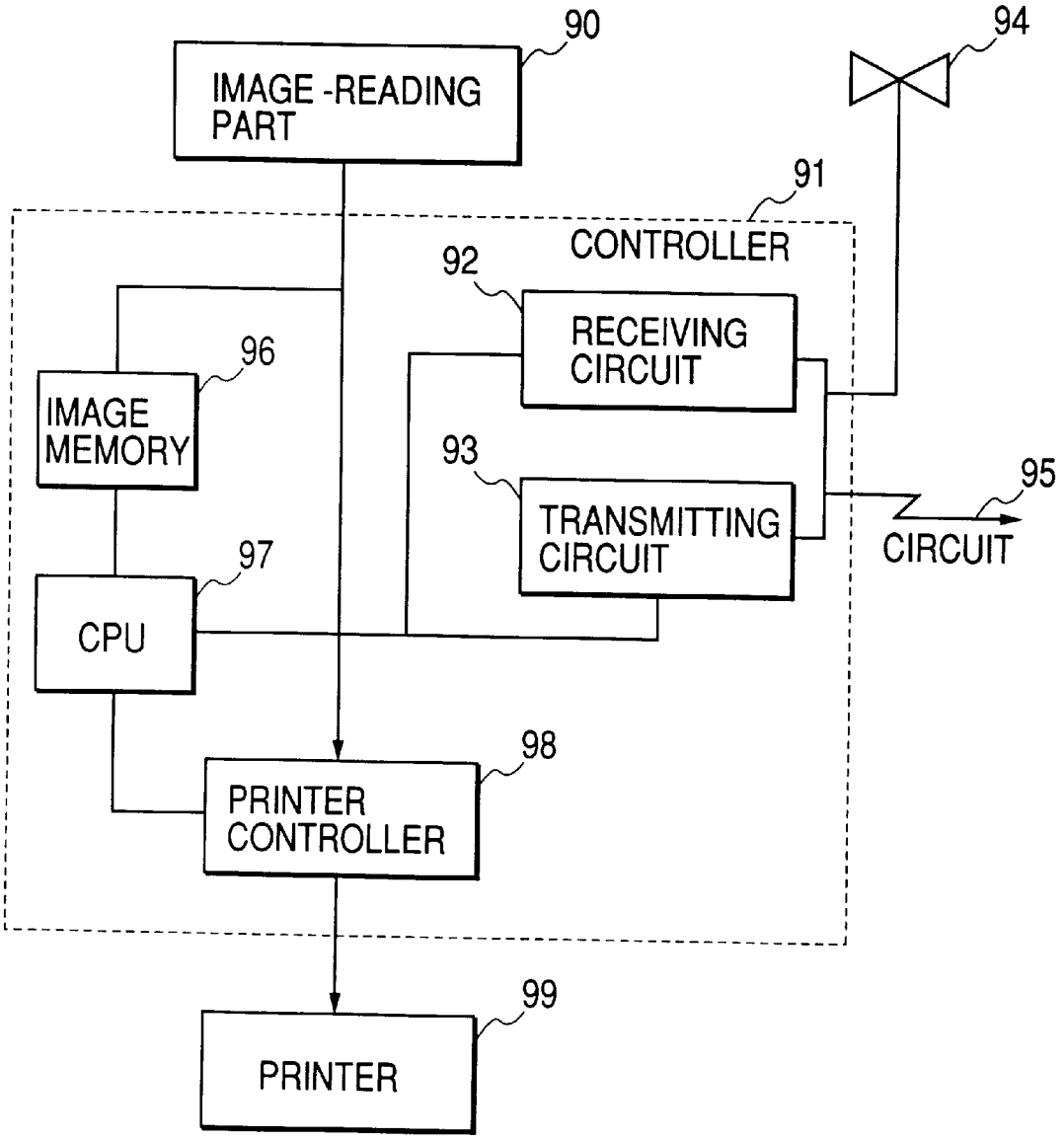
FIG. 13 is a block diagram of an image forming apparatus of the present invention applied to a printer of a facsimile machine.

In the case where the above image forming apparatus of the present invention is applied to a printer of a facsimile machine, the optical image exposure L is light exposure for printing of received data. FIG. 13 is a block diagram of an example for this case.

A controller 91 controls the image-reading part 90 and a printer 99. The entire of the controller 91 is controlled by a CPU 97. Readout data from the image reading part 90 is transmitted through a transmitting circuit 93 to the other communication station. Data received from the other communication station is transmitted through a receiving circuit 92 to the printer 99. The image data is stored in an image memory 96. A printer controller 98 controls the printer 99. The numeral 94 denotes a telephone set.

The image received through a circuit 95 (namely, image information from a remote terminal connected through the circuit) is demodulated by the receiving circuit 99, treated for decoding of the image information in the CPU 97, and successively stored in the image memory 96. When at least one page of image information has been store in the image memory 96, the images are recorded in such a manner that the CPU 97 reads out one page of the image information from the image memory 96, and sends out the one page of the decoded information to the printer controller 98, which controls the printer 99 on receiving the one page of the information from the CPU 97 to record the image information. During recording by the printer 99, the CPU 97 receives the subsequent page of information.

Images are received and recorded in the manner as described above.

As described above, the present invention relates to an image forming method employing a development-and-cleaning system in which a remaining toner on an image holding member after image development is recovered temporarily by a magnetic brush charger, and the recovered toner is transferred again to the image holding member in a development device. In this method, the size of the toner particles is controlled to have a weight-average particle diameter ($D_4$) not larger than ⅓ of average particle diameter of the magnetic particles in the magnetic brush charger, and the magnetic particles are controlled to contain particles of not larger than ⅓ of the average magnetic particle diameter at a content less than 5% by volume. Thereby, contamination of the magnetic particles by the toner and interception of the electric conduction path in the magnetic brush are prevented, and deterioration of the toner is prevented without excessive shearing of the recovered toner with magnetic particles. As the results, improvement can be achieved in the charging property of the magnetic brush charger, transferability of the toner from the magnetic brush charger to the image holding member, recoverablilty of the toner transferred to the image holding member, and developing properties of the toner recovered by the development device, which enables satisfactory image formation on many printing sheets.

The present invention is described below in more detail without limiting the invention thereto.

EXAMPLE 1

An image forming apparatus shown in FIG. 1 was used with an image holing member, a charging means, a latent image forming means, a development device, and transfer means shown below. A continuous image formation running test of 1000 sheets was conducted with the image forming apparatus.

(Image Holding Member)

An OPC photosensitive drum was prepared by laminating a subbing layer, a positive charge-injecting layer, a charge-generating layer, and a charge-transporting layer in the named order on an aluminum base drum of 30 mm diameter. On the surface of this OPC photosensitive drum, a charge-injecting layer was applied in a thickness of 3 μm by dip coating, the charge injection layer being composed of 100 parts by weight of a photosetting acrylic resin, 45 parts by weight of a polymerization initiator, and 277 parts by weight of ultra-fine $SnO_2$ particles of average particle diameter of 400 Å as electroconductive fine particles and 83 parts by weight of fine polytetrafluoroethylene resin particles of average particle diameter of 0.3 μm dispersed therein. This charge injection layer has a volume resistivity of $1\times10^{12}$ Ω.cm.

(Charging Step)

A magnetic brush charger was employed which was constituted of a nonmagnetic electroconductive sleeve, a magnet roll enclosed therein, and a magnetic brush formed by magnetic electroconductive particles magnetically confined on the electroconductive sleeve surface. The magnet roll was fixed, and the sleeve was rotated to move its surface in a direction reverse to the rotational movement of the photosensitive drum. The magnetic flux density on the surface of the sleeve was 950 Gauss at the position where the photosensitive member and the charging sleeve come closest. The breadth of adhesion of the magnetic particles on the magnetic brush charger was 200 mm. The amount of the magnetic particles of the magnetic brush was about 10 g and the minimum gap between the electroconductive sleeve 21 and the photosensitive drum 1 was controlled to 500 μm. The electroconductive sleeve was rotated to move its surface in a direction reverse to the movement of the photosensitive drum as shown in FIG. 1 at a rate of 150% of the peripheral speed of the photosensitive drum.

Ferrite particles (Magnetic Particle Powder 1) were used as the electroconductive magnetic particles. The ferrite particles are obtained by classification with sieves, and had an average particle diameter of 25 μm, a volume resistivity of $6\times10^7$ Ω.cm, a saturation magnetization of 58.0 $A.m^2/kg$ in a magnetic field of 1K oersted. The particle size distribution of the ferrite particles varies with the production lots. For obtaining a desired particle size distribution precisely independently of the production lots, the particles were classified repeatedly with sieves of meshes corresponding to the desired average particle diameter. Magnetic Particle Powder 1 was obtained by sieving twice for particle size adjustment with a 500-mesh screen which corresponds to the lower limit.

Figure 11:
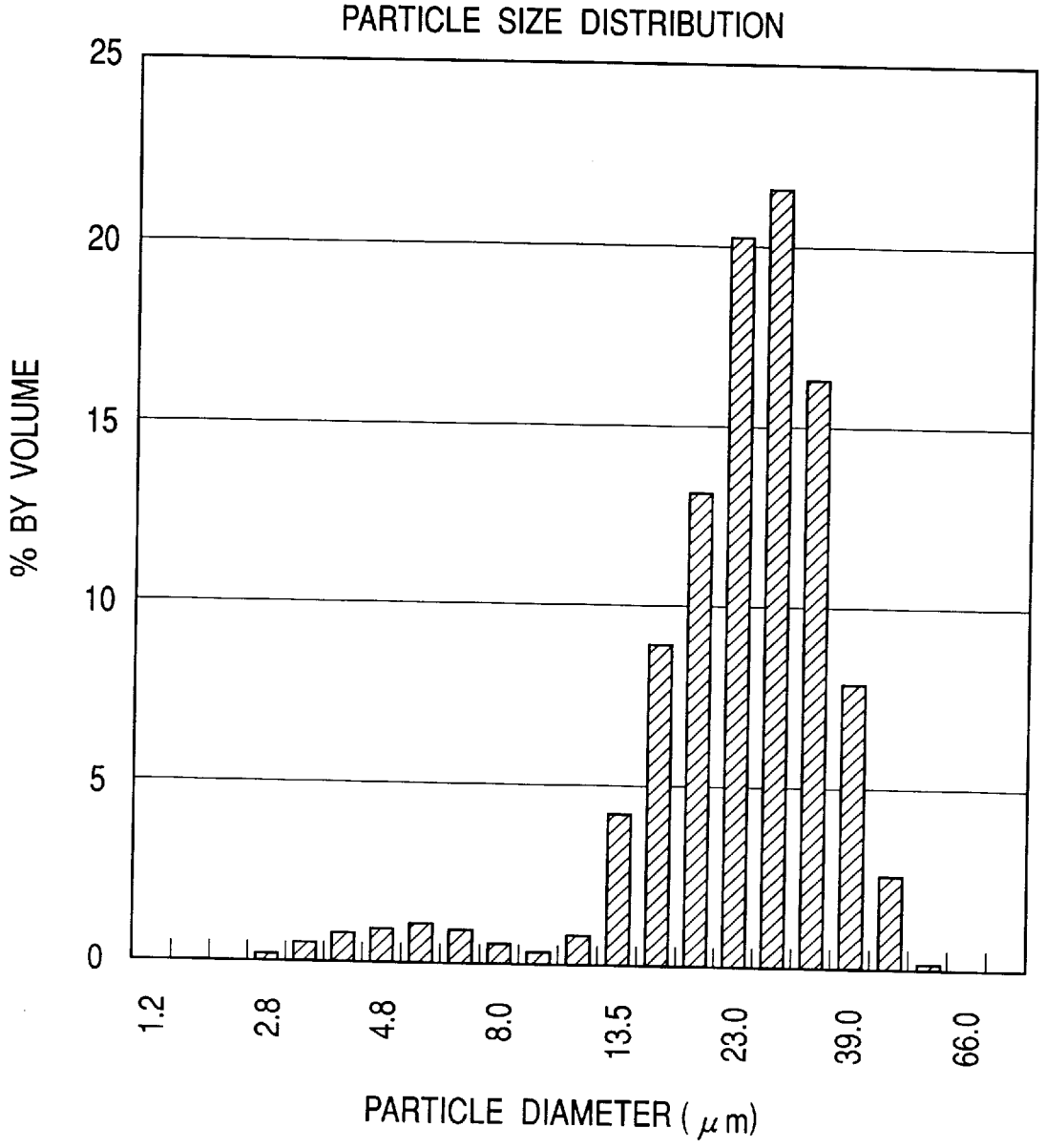
FIG. 11 shows a particle size distribution of Magnetic Particle Powder 1 employed in Example 1.

This Magnetic Particle Powder 1 contained the particles of not larger ⅓ (about 8.3 μm) of the average particle diameter (25 μm) at a content of about 4.5% by volume, the particles not smaller than 1.5 times (36 μm) the average diameter(25 μm) at a content of 10.3% by volume, and the particles of ⅔ to ⅓ (about 16.7 to about 33.3 μm) of the average particle diameter (25 μm) at a content of about 79.8% by volume. Table 2 and FIG. 11 show the particle size distribution of Magnetic Particle Powder I. The charging bias of DC voltage of −700 V was applied to the electroconductive sleeve of the magnetic brush charger to electrify the surface of the photosensitive drum surface uniformly at −700 V.

(Latent Image Formation Step)

As the latent image forming means, a laser beam was employed which was intensity-modulated in correspondence with the time sequence of electric digital picture signals of image information outputted from a laser beam scanner. The peripheral face of the photosensitive drum was scanned with the laser beam to form an electrostatic latent image.

(Development Step)

A contact development apparatus as shown in FIG. 6 was employed with two-component developer. A toner image was formed by reversely developing the electrostatic latent image formed on the photosensitive drum surface.

The toner constituting the two-component developer was a negative-charging nonmagnetic toner (Toner 1) prepared by melt-blending 5 parts by weight of carbon black, 100 parts by weight of a styrene-acrylic resin, and a negative charge-controlling agent, and pulverizing and classifying it, and adding thereto an external additive (fine powdery hydrophobic titanium oxide), the toner having a weight-average particle diameter ($D_4$) of 7 μm.

The magnetic carrier constituting the two-component developer was a resin-coated carrier composed of ferrite particles coated by a silicone resin, having a weight-average particle diameter of 40 μm.

The toner concentration in the two-component developer was adjusted to about 6% by weight.

The development was conducted with the gap A of 500 μm between the end face of the nonmagnetic blade and the surface of the development sleeve; the gap B of 500 μm between the development sleeve surface and the photosensitive drum surface; and the development nip C of 6 mm; under application a development bias of rectangle wave of DC voltage of −500 V, alternate electric field of peak-to-peak voltage of 1500 V, and frequency of 2000 Hz between the development sleeve and the photosensitive drum.

(Transfer Step)

The transfer means was a transfer roller constituted of a core metal and a medium-resistance foam layer having a resistivity of $5\times10^8$ Ω.cm on application of 2 kV. This transfer roller was brought into pressure contact with the reverse side of the transfer-receiving medium to press the transfer-receiving medium against the photosensitive member drum surface. A transfer voltage of +2 kV was applied to the core metal on image transfer.

(Fixation Step)

The toner image transferred onto the surface of the transfer-receiving medium was fixed by heating with a heat roller fixation device constituted of a heating roller and a pressing roller.

(Untransferred Remaining Toner Recovery Step)

The toner not transferred onto the transfer-receiving medium and remaining on the photosensitive drum was recovered temporarily by the magnetic brush charger from the photosensitive drum, and then again transferred to the photosensitive drum. This toner was recovered from the photosensitive drum in the development step by the development device.

(Evaluation)

(1) Charging ability

The charging ability was evaluated by conducting image formation running tests with the above image forming apparatus. Uniformity of electrification was evaluated from ghost image formation and fogging at a solid white portion caused by poor electrification one cycle after the light exposure at the respective number of image formation. The evaluation standard is shown below:

(Evaluation Standard)

The charging ability was evaluated one cycle after the exposure.

A: Excellent charging without a charging ghost without fogging caused by nonuniform charging, B: Slight fogging by nonuniform charging observed without formation of charging ghost, C: Slight charging ghost observed after repeated solid image printing, D: Charging ghost being remarkable in a solid white area, or poor image being formed by carrier adhesion.

Table 3 shows the evaluation results.

EXAMPLE 2

The image formation was conducted and the evaluation was made in the same manner as in Example 1 except that Magnetic Particle Powder 1 of the magnetic brush charger was replaced by Magnetic Particle Powder 2 having an average particle diameter of 50 μm as shown in Table 3.

As the results, the initial charging ability was lightly lower than in Example 1 owing to a larger particle size of the magnetic particles, but the charging ability was not deteriorated during the running test since the contact area between the magnetic particles and the photosensitive member surface was kept unchanged owing to the smaller size of the toner relative to the magnetic particles.

Table 3 shows the results.

EXAMPLES 3–17

The image formation was conducted and the evaluation was made in the same manner as in Example 1 except that Magnetic Particle Powder 1 of the magnetic brush charger and Toner 1 of the two-component developer were respectively replaced by the ones shown in Table 3.

In Example 4, the base particles before the classification of Magnetic Particle Powder 4 was the same as the base particles before the classification of Magnetic Particle Powder 1 in the composition, but was produced in a separate production lot, and the particle size distribution was adjusted by sieving twice with a 500-mesh screen as the lower limit.

Table 3 shows the results.

COMPARATIVE EXAMPLES 1–3

The image formation was conducted and the evaluation was made in the same manner as in Example 1 except that Magnetic Particle Powder 1 of the magnetic brush charger and Toner 1 of the two-component developer were respectively replaced by the ones shown in Table 3.

In Comparative Example 1, the formed image quality was poor owing to adhesion of the magnetic particles to the photosensitive member caused by a smaller average particle size of Magnetic Particle Powder 12.

In Comparative Example 2, the initial charging ability was sufficient. However, the weight-average particle diameter of Toner 5 was large for the average particle diameter of Magnetic Particle Powder 1, which caused decrease of the contact area between the magnetic particle and the photosensitive member surface by untransferred remaining toner introduced into the charging brush after 1000 sheets of image formation to decrease the charging area on the photosensitive member, resulting in failure of electrification.

In Comparative Example 3, Magnetic Particle Powder 15 was obtained from the same base particles as Magnetic Particle Powder 4, and had the same average particle diameter 25 μm as Magnetic Particle Powder 4. The particle size distribution of the base material was broad, and after sieving with a lower-limit 500-mesh screen, the powder contained particle of ⅓ (8 μm) of the average diameter (25 μm) or smaller at a content of as high as 8% by volume. Accordingly, the magnetic particles adhere to the photosensitive member to form poor image. Further, with continuation of the running test, since the powder contained particle of 3 times the average diameter or smaller particles are contained in a larger amount, the contact area between the magnetic particle and the photosensitive member surface is decreased by untransferred remaining toner introduced into the charging brush to decrease the charging area on the photosensitive member, resulting in failure of electrification.

Table 3 shows the results.

EXAMPLE 18

Magnetic Particle Powder 16 (ferrite particles) was prepared from a base particles having the same composition as that of Example 1 but was produced in a separate production lot, and was classified by sieving twice with a 500-mesh screen. This magnetic particle powder had an average particle diameter of 26 μm, and contained the particles of not larger ⅓ (about 8.7 μm) of the average particle diameter (26 μm) at a content of about 2.7% by volume, the particles not smaller than 1.5 times (39 μm) the average diameter (26 μm) at a content of about 1.0% by volume, and the particles of ⅔ to ⅘ (about 17.3 to about 34.7 μm) of the average particle diameter (26 μm) at a content of about 70.7% by volume. This Magnetic Particle Powder 16 had a volume resistivity of $5\times10^8$ Ω.cm.

A toner (Toner 6) constituting a nonmagnetic negative two-component developer was prepared by suspension-polymerizing a monomer composition containing a polymerizable monomer, a colorant, and a negative charge controlling agent in an aqueous medium to obtain a spherical toner particles and adding thereto an external additive (fine particulate hydrophobic titanium oxide). This Tone 6 had a weight-average particle diameter ($D_4$) of 6.5 μm.

A running test of continuous image formation of 5000 sheet was conducted and evaluation was made in the same manner as in Example 1 except that Magnetic Particle Powder 1 was replaced by Magnetic Particle Powder 16, Toner 1 of the two-component developer was replaced by the negative charging toner (Toner 6).

The results are shown in Table 4.

EXAMPLE 19

Magnetic Particle Powder 17 was prepared by mixing 90 parts by weight of spherical ferrite particles having a volume resistivity of $5\times10^7$ Ω.cm as the main magnetic particles and 10 parts by weight of spherical ferrite particles having a volume resistivity of $8\times10^4$ Ω.cm as the auxiliary magnetic particles. Image formation was conducted and evaluation was made in the same manner as in Example 18 except that Magnetic Particle Powder 16 in Example 18 was replaced by Magnetic Particle Powder 17.

Table 4 shows the results.

EXAMPLES 20–28, AND COMPARATIVE EXAMPLES 4–6

Image formation was conducted and evaluation was made in the same manner as in Example 18 except the Magnetic Particle Powder 16 in Example 18 was replaced by Magnetic Particle Powder shown in Table 4.

Table 4 shows the results.

EXAMPLE 29

Magnetic Particle Powder 29 (ferrite particles) was prepared from base particles having the same composition as that of Example 1 but was produced in a separate production lot, and was classified by sieving twice with a 400-mesh screen. This magnetic particle powder had an average particle diameter of 30 μm, and contained the particles of not larger ⅓ (10 μm) of the average particle diameter (30 μm) at a content of about 2.9% by volume, the particles not smaller than 2 times (45 μm) the average particle diameter(30 μm) at a content of about 2.8% by volume, and the particles of ⅔ to ⅘ (20 to 40 μm) of the average particle diameter (30 μm) at a content of about 84.3% by volume. This Magnetic Particle Powder 29 had a volume resistivity of $8\times10^7$ Ω.cm.

A toner (Toner 8) constituting a nonmagnetic negative charging two-component developer was prepared by melt-blending 5 parts by weight of carbon black, 100 parts by weight of a styrene-acrylic resin, and a negative charge controlling agent, pulverizing and classifying it, and adding thereto an external additive (fine particulate hydrophobic titanium oxide). This Toner 8 had a weight-average particle diameter ($D_4$) of 6.8 μm.

A running test of continuous image formation of 10000 sheet was conducted and evaluation was made in the same manner as in Example 1 except that Magnetic Particle Powder 1 was replaced by Magnetic Particle Powder 29, the charging bias applied to the electroconductive sleeve of the magnetic brush charger was changed to DC bias of −650 V, and Toner 1 constituting the two-component developer was replaced by the nonmagnetic negative charging toner (Toner 8).

The results are shown in Table 5.

EXAMPLE 30

Image formation was conducted and evaluated in the same manner as in Example 29 except that an AC component of rectangle wave of the frequency 1.0 kHz and the amplitude of 800 Vpp was superposed to the DC voltage of −700 V as the charging bias applied the electroconductive sleeve of the magnetic brush charger.

Table 5 shows the results.

EXAMPLES 31–35 AND COMPARATIVE EXAMPLES 7–9

Image formation was conducted and evaluation was made in the same manner as in Example 29 except that the Magnetic Particle Powder and a the two-component developer Toner 8 were replaced by those shown in Table 5, and the charging bias applied to the electroconductive sleeve of the magnetic brush charger was changed to a superposed bias of a DC voltage of −700 V and an AC component of a rectangle wave of frequency 1.0 kHz, and amplitude 800 Vpp similarly as in Example 30.

The results are shown in Table 5.

TABLE 1

| Particle Diameter (d) Range (μm) | Particle Diameter Range (μm) | Particle Diameter Range (μm) | Particle Diameter Range (μm) |
|---|---|---|---|
| 0.05 ≦ d < 1.8 | 6.2 ≦ d < 7.4 | 25.0 ≦ d < 30.0 | 102.0 ≦ d < 122.0 |
| 1.8 ≦ d < 2.2 | 7.4 ≦ d < 8.6 | 30.0 ≦ d < 36.0 | 122.0 ≦ d < 146.0 |
| 2.2 ≦ d < 2.6 | 8.6 ≦ d < 10.0 | 36.0 ≦ d < 42.0 | 146.0 ≦ d < 174.0 |
| 2.6 ≦ d < 3.0 | 10.0 ≦ d < 12.0 | 42.0 ≦ d < 50.0 | 174.0 ≦ d < 206.0 |
| 3.0 ≦ d < 3.6 | 12.0 ≦ d < 15.0 | 50.0 ≦ d < 60.0 | 206.0 ≦ d < 246.0 |
| 3.6 ≦ d < 4.4 | 15.0 ≦ d < 18.0 | 60.0 ≦ d < 72.0 | 246.0 ≦ d < 294.0 |
| 4.4 ≦ d < 5.2 | 18.0 ≦ d < 21.0 | 72.0 ≦ d < 86.0 | 294.0 ≦ d < 350.0 |
| 5.2 ≦ d < 6.2 | 21.0 ≦ d < 25.0 | 86.0 ≦ d < 102.0 | |

TABLE 2

| Particle diameter d (μm) | Cumulation (% by volume) | Frequency (% by volume) | Central Particle diameter (μm) |
|---|---|---|---|
| 0.5 ≦ d < 1.8 | 0 | 0 | 1.2 |
| 1.8 ≦ d < 2.2 | 0 | 0 | 2.0 |
| 2.2 ≦ d < 2.6 | 0.01 | 0.01 | 2.4 |
| 2.6 ≦ d < 3.0 | 0.12 | 0.11 | 2.8 |
| 3.0 ≦ d < 3.6 | 0.56 | 0.44 | 3.3 |
| 3.6 ≦ d < 4.1 | 1.36 | 0.80 | 4.0 |
| 4.1 ≦ d < 5.2 | 2.22 | 0.86 | 4.8 |
| 5.2 ≦ d < 6.2 | 3.20 | 0.98 | 5.7 |

TABLE 2-continued

| Particle diameter d (μm) | Cumulation (% by volume) | Frequency (% by volume) | Central Particle diameter (μm) |
|---|---|---|---|
| 6.2 ≦ d < 7.4 | 4.05 | 0.85 | 6.8 |
| 7.4 ≦ d < 8.6 | 4.54 | 0.49 | 8.0 |
| 8.6 ≦ d < 10.0 | 4.81 | 0.27 | 9.3 |
| 10.0 ≦ d < 12.0 | 5.60 | 0.79 | 11.0 |
| 12.0 ≦ d < 15.0 | 9.86 | 4.26 | 13.5 |
| 15.0 ≦ d < 18.0 | 18.65 | 8.79 | 16.5 |
| 18.0 ≦ d < 21.0 | 31.73 | 13.08 | 19.5 |
| 21.0 ≦ d < 25.0 | 51.92 | 20.19 | 23.0 |
| 25.0 ≦ d < 30.0 | 73.43 | 21.51 | 27.5 |
| 30.0 ≦ d < 36.0 | 89.66 | 16.23 | 33.0 |
| 36.0 ≦ d < 42.0 | 97.51 | 7.85 | 39.0 |
| 42.0 ≦ d < 50.0 | 99.91 | 2.40 | 46.0 |
| 50.0 ≦ d < 60.0 | 100.00 | 0.09 | 55.0 |
| 60.0 ≦ d < 72.0 | 100.00 | 0 | 66.0 |
| 72.0 ≦ d < 86.0 | 100.00 | 0 | 79.0 |

TABLE 3

| | Magnetic Particle Powder | | | | | | | | |
|---|---|---|---|---|---|---|---|---|---|
| | Magnetic particle powder | Average particle diameter | Particle size distribution (vol %)* | | | | | Saturation magnet-ization | Volume resistivity |
| | No. *1 | (μm) | ≦(1/3)$d_{av}$ | (2/3)$d_{av}$–(4/3)$d_{av}$ | 1.5$d_{av}$≦ | SF-1 | SF-2 | ($Am^2$/kg) | (Ω · cm) |
| Example | | | | | | | | | |
| 1 | 1 | 25 | 4.5 | 79.8 | 10.3 | 140 | 120 | 58.0 | $6 \times 10^7$ |
| 2 | 2 | 50 | 3.2 | 85.5 | 3.5 | 140 | 120 | 58.0 | $6 \times 10^7$ |
| 3 | 3 | 21 | 4.5 | 80.0 | 5.4 | 140 | 120 | 58.0 | $6 \times 10^7$ |
| 4 | 4 | 25 | 3.1 | 68.2 | 14.2 | 140 | 120 | 58.0 | $6 \times 10^7$ |
| 5 | 5 | 25 | 4.1 | 67.1 | 4.0 | 140 | 120 | 58.0 | $6 \times 10^7$ |
| 6 | 6 | 30 | 2.9 | 84.3 | 2.7 | 140 | 120 | 58.0 | $6 \times 10^7$ |
| 7 | 6 | 30 | 2.9 | 84.3 | 2.7 | 140 | 120 | 58.0 | $6 \times 10^7$ |
| 8 | 1 | 25 | 4.5 | 79.8 | 10.3 | 140 | 120 | 58.0 | $6 \times 10^7$ |
| 9 | 1 | 25 | 4.5 | 79.8 | 10.3 | 140 | 120 | 58.0 | $6 \times 10^7$ |
| 10 | 7 | 25 | 3.9 | 78.2 | 10.3 | 150 | 130 | 58.0 | $6 \times 10^7$ |
| 11 | 8 | 25 | 3.7 | 79.1 | 11.1 | 130 | 115 | 58.0 | $6 \times 10^7$ |
| 12 | 9 | 25 | 4.3 | 80.5 | 10.7 | 120 | 110 | 58.0 | $6 \times 10^7$ |
| 13 | 9 | 25 | 4.3 | 80.5 | 10.7 | 120 | 110 | 58.0 | $6 \times 10^7$ |
| 14 | 10 | 25 | 4.3 | 79.5 | 11.4 | 140 | 120 | 58.0 | $5 \times 10^8$ |
| 15 | 11 | 25 | 3.8 | 80.3 | 10.3 | 140 | 120 | 58.0 | $3 \times 10^8$ |
| 16 | 12 | 25 | 4.2 | 81.1 | 7.8 | 140 | 120 | 60.7 | $3 \times 10^6$ |
| 17 | 13 | 25 | 3.9 | 78.7 | 9.5 | 140 | 129 | 54.3 | $3 \times 10^8$ |
| Comparative Example | | | | | | | | | |
| 1 | 14 | 14 | 4.7 | 79.6 | 15.1 | 140 | 120 | 58.0 | $6 \times 10^7$ |
| 2 | 1 | 25 | 4.5 | 79.8 | 10.3 | 140 | 120 | 58.0 | $6 \times 10^7$ |
| 3 | 15 | 25 | 8.0 | 69.3 | 0.7 | 140 | 120 | 58.0 | $6 \times 10^7$ |

| | Toner | | | | | Charging Ability | | |
|---|---|---|---|---|---|---|---|---|
| | Toner No. *2 | Weight-average particle diameter ($D_4$) (μm) | SF-1 | SF-2 | $D_4/d_{av}$ ** | Start | 500-sheet running test | 1000-sheet running test |
| Example | | | | | | | | |
| 1 | 1 | 7.0 | 170 | 160 | 0.28 | A | A | B |
| 2 | 1 | 7.0 | 170 | 160 | 0.14 | B | B | B |
| 3 | 1 | 7.0 | 170 | 160 | 0.33 | A | A | B |
| 4 | 1 | 7.0 | 170 | 160 | 0.28 | A | B | B |
| 5 | 1 | 7.0 | 170 | 160 | 0.28 | A | B | B |
| 6 | 2 | 9.6 | 170 | 160 | 0.20 | A | B | B |
| 7 | 3 | 6.0 | 170 | 160 | 0.28 | A | A | A |

TABLE 3-continued

| | | | | | | | | |
|---|---|---|---|---|---|---|---|---|
| 8 | 4 | 7.0 | 155 | 145 | 0.28 | A | A | A |
| 9 | 5 | 7.0 | 145 | 125 | 0.28 | A | B | B |
| 10 | 4 | 7.0 | 155 | 145 | 0.28 | A | A | A |
| 11 | 4 | 7.0 | 155 | 145 | 0.28 | A | A | A |
| 12 | 4 | 7.0 | 155 | 145 | 0.28 | A | A | A |
| 13 | 5 | 7.0 | 145 | 125 | 0.28 | A | A | A |
| 14 | 1 | 7.0 | 170 | 160 | 0.28 | A | B | C |
| 15 | 1 | 7.0 | 170 | 160 | 0.28 | A | A | A |
| 16 | 1 | 7.0 | 170 | 160 | 0.28 | A | A | B |
| 17 | 1 | 7.0 | 170 | 160 | 0.28 | A | A | B |
| Comparative Example | | | | | | | | |
| 1 | 1 | 7.0 | 170 | 160 | 0.50 | B | D | D |
| 2 | 5 | 13.0 | 170 | 160 | 0.52 | D | D | D |
| 3 | 1 | 7.0 | 170 | 160 | 0.28 | A | C | D |

*$\leqq(1/3)d_{av}$: Content (vol %) of particles of not larger than ⅓ of average particle diameter, $(2/3)d_{av}$–$(4/3)d_{av}$: Content (vol %) of particles of ⅔ to ⅓ of average particle diameter, $1.5\ d_{av}\leqq$: Content (vol %) of particles of not smaller than 1.5 times the average particle diameter

**$D_4/d_{av}$: (Weight-average particle diameter of toner)/(average particle diameter of magnetic particles)

*1 Magnetic Particle Powder 2: prepared by changing sieving conditions of Magnetic Particle Powder 1, Magnetic Particle Powder 3: prepared by changing sieving conditions of Magnetic Particle Powder 1, Magnetic particle Powder 4: prepared from base particles having the same composition as the base material of Magnetic Particle Powder 1 but of different production lot by sieving twice with 500-mesh screen, Magnetic Particle Powder 5: prepared by changing sieving conditions of Magnetic Particle Powder 1, Magnetic Particle Powder 6: prepared by changing sieving conditions of Magnetic Particle Powder 1, Magnetic Particle Powder 7: prepared by lowering baking temperature of Magnetic Particle Powder 1, Magnetic Particle Powder 8: prepared by raising baking temperature of Magnetic Particle Powder 1, Magnetic Particle Powder 9: prepared by raising further baking temperature higher than Magnetic Particle Powder 8, Magnetic Particle Powder 10: prepared by oxidation of Magnetic Particle Powder 1 to have higher resistance, Magnetic Particle Powder 11: prepared by reduction of Magnetic Particle Powder 1 to have lower resistance, Magnetic Particle Powder 12: prepared by changing composition of ferrite component of Powder Particle Powder 1, Magnetic Particle Powder 13: prepared by changing composition of ferrite component of Powder Particle Powder 1, Magnetic Particle Powder 14: prepared by changing sieving conditions of Magnetic Particle Powder 1, Magnetic Particle Powder 15: prepared by changing sieving conditions of Magnetic Particle Powder 4 by sieving once base particles of Magnetic Particle 4 before classification

*2 Toner 2: prepared from the same formulation as Toner 1 by changing pulverization and classification conditions, Toner 3: prepared from the same formulation as Toner 1 by changing pulverization and classification conditions, Toner 4: prepared by treating Toner 1 by mechanical impact for sphericity, Toner 5: prepared by treating Toner 1 by mechanical impact for sphericity

TABLE 4

| | Magnetic Particle Powder | | | | | | |
|---|---|---|---|---|---|---|---|
| | Magnetic particle powder | Average particle diameter | Particle size distribution (vol %)* | | | | |
| | No. *1 | (μm) | $\leqq(1/3)d_{av}$ | $(2/3)d_{av}$–$(4/3)d_{av}$ | $1.5d_{av}\leqq$ | SF-1 | SF-2 |
| Example | | | | | | | |
| 18 | 16 | 26 | 2.7 | 70.7 | 1.0 | 140 | 120 |
| 19 | 17 | 26 | 2.3 | 70.6 | 1.3 | 140 | 120 |
| 20 | 18 | 26 | 2.7 | 72.3 | 1.5 | 140 | 120 |
| 21 | 19 | 26 | 2.6 | 70.0 | 1.4 | 140 | 120 |
| 22 | 20 | 26 | 3.1 | 70.5 | 3.5 | 140 | 120 |
| 23 | 21 | 26 | 3.3 | 71.2 | 4.6 | 140 | 120 |
| 24 | 22 | 26 | 2.4 | 72.1 | 1.6 | 140 | 120 |
| 25 | 23 | 26 | 3.1 | 72.4 | 1.7 | 150 | 130 |
| 26 | 24 | 26 | 2.5 | 70.7 | 1.8 | 120 | 110 |
| 27 | 25 | 26 | 3.0 | 68.2 | 13.4 | 140 | 120 |
| 28 | 26 | 26 | 4.1 | 66.7 | 1.0 | 140 | 120 |
| Comparative Example | | | | | | | |
| 4 | 27 | 15 | 4.8 | 78.9 | 5.6 | 140 | 120 |
| 5 | 16 | 26 | 2.7 | 70.7 | 1.o | 140 | 120 |
| 6 | 28 | 26 | 8.7 | 67.1 | 4.8 | 140 | 120 |

TABLE 4-continued

| | Main magnetic particles | | | Auxiliary magnetic particles | | |
|---|---|---|---|---|---|---|
| | Average particle diameter (μm) | Volume resistivity (Ω · cm) | Mixing ratio (wt parts) | Average particle diameter (μm) | Volume resistivity (Ω · cm) | Mixing ratio (wt parts) |
| Example | | | | | | |
| 18 | 26 | $5 \times 10^8$ | 100 | — | — | 0 |
| 19 | 26 | $5 \times 10^8$ | 90 | 26 | $8 \times 10^4$ | 10 |
| 20 | 26 | $5 \times 10^8$ | 55 | 26 | $8 \times 10^4$ | 45 |
| 21 | 26 | $5 \times 10^8$ | 98 | 26 | $8 \times 10^4$ | 2 |
| 22 | 26 | $5 \times 10^8$ | 90 | 26 | $4 \times 10^5$ | 10 |
| 23 | 26 | $3 \times 10^9$ | 90 | 26 | $8 \times 10^4$ | 10 |
| 24 | 26 | $8 \times 10^4$ | 90 | 26 | $8 \times 10^4$ | 10 |
| 25 | 26 | $5 \times 10^8$ | 90 | 26 | $8 \times 10^4$ | 10 |
| 26 | 26 | $5 \times 10^8$ | 90 | 26 | $8 \times 10^4$ | 10 |
| 27 | 26 | $5 \times 10^8$ | 90 | 26 | $8 \times 10^4$ | 10 |
| 28 | 26 | $5 \times 10^8$ | 90 | 26 | $8 \times 10^4$ | 10 |
| Comparative Example | | | | | | |
| 4 | 15 | $5 \times 10^8$ | 90 | 15 | $8 \times 10^4$ | 10 |
| 5 | 26 | $5 \times 10^8$ | 90 | 26 | $8 \times 10^4$ | 10 |
| 6 | 26 | $5 \times 10^8$ | 90 | 26 | $8 \times 10^4$ | 10 |

| | Toner | | | | | | | |
|---|---|---|---|---|---|---|---|---|
| | | | Charging ability | | | | | |
| | Toner No. *4 | Weight-average particle diameter ($D_4$) (μm) | SF-1 | SF-2 | $D_4/d_{av}$ ** | Start | 1000-sheet running test | 5000-sheet running test |
| Example | | | | | | | | |
| 18 | 6 | 6.5 | 115 | 110 | 0.26 | A | C | — |
| 19 | 6 | 6.5 | 115 | 110 | 0.26 | A | A | B |
| 20 | 6 | 6.5 | 115 | 110 | 0.26 | A | A | A |
| 21 | 6 | 6.5 | 115 | 110 | 0.26 | A | B | C |
| 22 | 6 | 6.5 | 115 | 110 | 0.26 | A | B | C |
| 23 | 6 | 6.5 | 115 | 110 | 0.26 | B | B | C |
| 24 | 6 | 6.5 | 115 | 110 | 0.26 | A | A | A |
| 25 | 6 | 6.5 | 115 | 110 | 0.26 | A | A | B |
| 26 | 6 | 6.5 | 115 | 110 | 0.26 | A | A | A |
| 27 | 6 | 6.5 | 115 | 110 | 0.26 | A | B | B |
| 28 | 6 | 6.5 | 115 | 110 | 0.26 | A | B | B |
| Comparative Example | | | | | | | | |
| 4 | 6 | 6.5 | 115 | 110 | 0.43 | A | C | D |
| 5 | 7 | 10.0 | 115 | 110 | 0.38 | B | D | D |
| 6 | 6 | 6.5 | 115 | 110 | 0.26 | A | C | D |

*≦(⅓)$d_{av}$: Content (vol %) of particles of not larger than ⅓ of average particle diameter (⅔)$d_{av}$–(⅓)$d_{av}$: Content (vol %) of particles of ⅔ to ⅓of average particle diameter 1.5 $d_{av}$≦: Content (vol %) of particles of not smaller than 1.5 times the average particle diameter

**$D_4/d_{av}$: (Weight-average particle diameter of toner)/(average particle diameter of magnetic particles)

*3 Magnetic Particle Powder 17: mixture of 90 parts of Magnetic Particle Powder 16 (main magnetic particles) and 10 parts of low-resistant auxiliary magnetic particles, Magnetic Particle Powder 18: mixture of 55 parts of Magnetic Particle Powder 16 (main magnetic particles) and 45 parts of low-resistant auxiliary magnetic particles, Magnetic Particle Powder 19: mixture of 98 parts of Magnetic Particle Powder 16 (main magnetic particles) and 2 parts of low-resistant auxiliary magnetic particles, Magnetic Particle Powder 20: mixture of 90 parts of Magnetic Particle Powder 16 (main magnetic particles) and 10 parts of high-resistant auxiliary magnetic particles prepared by oxidation treatment of the above auxiliary magnetic particles, Magnetic Particle Powder 21: mixture of 90 parts of high-resistant main magnetic particles prepared by oxidation treatment of Magnetic Particle Powder 16 and 10 parts of low-resistant auxiliary magnetic particles used for Magnetic Particle Powder 17, Magnetic Particle Powder 22: mixture of 90 parts of low-resistant main magnetic particles prepared by reduction treatment of Magnetic Particle Powder 16 and 10 parts of low-resistant auxiliary magnetic particles used for Magnetic Particle Powder 17, Magnetic Particle Powder 23: materials being the same as Magnetic Particle Powder 17 except that the sphericity of both the main magnetic particle powder and the auxiliary particle powder were lowered by lowering the baking temperatures in the production process, TABLE 4-continued Magnetic Particle Powder 24: Sphericity being increased by raising the baking temperatures of Magnetic Particle Powder 23,
Magnetic Particle Powder 25: materials being the same as Magnetic Particle Powder 17 except that the sieving conditions were changed for both main magnetic particles and auxiliary particles,
Magnetic Particle Powder 26: materials being the same as Magnetic Particle Powder 17 except that the sieving conditions were changed for both main magnetic particles and auxiliary particles,
Magnetic Particle Powder 27: materials being the same as Magnetic Particle Powder 17 except that the sieving conditions were changed for both main magnetic particles and auxiliary particles,
Magnetic Particle Powder 28: materials being the same as Magnetic Particle Powder 17 except that the sieving conditions were changed for both main magnetic particles and auxiliary particles
*4 Toner 7: produced by changing the conditions of suspension and classification in aqueous medium of the monomer compositions in the toner production

TABLE 5

| | Magnetic Particle Powder | | | | | | | | |
|---|---|---|---|---|---|---|---|---|---|
| | Magnetic particle powder | Average particle diameter | Particle size distribution (vol %)* | | | | | Saturation magnet-ization | Volume resistivity |
| | No. *5 | ($\mu$m) | $\leqq(1/3)d_{av}$ | $(2/3)d_{av}-(4/3)d_{av}$ | $1.5d_{av}\leqq$ | SF-1 | SF-2 | ($Am^2/kg$) | ($\Omega \cdot cm$) |
| Example | | | | | | | | | |
| 29 | 29 | 30 | 2.9 | 84.3 | 2.8 | 140 | 120 | 58.0 | $8 \times 10^7$ |
| 30 | 29 | 30 | 2.9 | 84.3 | 2.8 | 140 | 120 | 58.0 | $8 \times 10^7$ |
| 31 | 29 | 30 | 2.9 | 84.3 | 2.8 | 140 | 120 | 58.0 | $6 \times 10^7$ |
| 32 | 29 | 30 | 2.9 | 84.3 | 2.8 | 140 | 120 | 58.0 | $8 \times 10^7$ |
| 33 | 30 | 30 | 2.7 | 82.8 | 3.1 | 120 | 110 | 58.0 | $8 \times 10^7$ |
| 34 | 31 | 30 | 3.2 | 69.5 | 11.5 | 140 | 120 | 58.0 | $8 \times 10^7$ |
| 35 | 32 | 30 | 4.1 | 66.8 | 8.7 | 140 | 120 | 58.0 | $8 \times 10^7$ |
| Comparative Example | | | | | | | | | |
| 7 | 33 | 15 | 4.7 | 79.6 | 3.4 | 140 | 120 | 58.0 | $8 \times 10^7$ |
| 8 | 29 | 30 | 2.9 | 84.3 | 2.8 | 140 | 120 | 58.0 | $8 \times 10^7$ |
| 9 | 34 | 30 | 9.0 | 68.0 | 1.0 | 140 | 120 | 58.0 | $8 \times 10^7$ |

| | Toner | | | | | | Charging Ability | | |
|---|---|---|---|---|---|---|---|---|---|
| | Toner No. *6 | Weight-average particle diameter ($D_4$) ($\mu$m) | SF-1 | SF-2 | $D_4/d_{av}$ ** | Electri-fying bias | Start | 500-sheet running test | 1000-sheet running test |
| Example | | | | | | | | | |
| 29 | 8 | 6.8 | 165 | 155 | 0.23 | DC | A | B | C |
| 30 | 8 | 6.8 | 165 | 155 | 0.23 | DC + AC | A | B | B |
| 31 | 9 | 6.8 | 150 | 125 | 0.23 | DC + AC | A | A | B |
| 32 | 10 | 6.8 | 170 | 160 | 0.23 | DC + AC | A | B | B |
| 33 | 8 | 6.8 | 165 | 155 | 0.23 | DC + AC | A | A | A |
| 34 | 8 | 6.8 | 165 | 155 | 0.23 | DC + AC | A | B | B |
| 35 | 9 | 6.8 | 150 | 125 | 0.23 | DC + AC | A | B | B |
| Comparative Example | | | | | | | | | |
| 7 | 8 | 6.8 | 165 | 155 | 0.45 | DC + AC | D | — | — |
| 8 | 11 | 10.5 | 165 | 155 | 0.35 | DC + AC | B | C | D |
| 9 | 8 | 6.8 | 165 | 155 | 0.23 | DC + AC | A | C | D |

*5 Magnetic Particle Powder 30: produced in the same manner as Magnetic Particle Powder 29 except that the baking temperature was raised,
Magnetic Particle Powder 31: produced in the same manner as Magnetic Particle Powder 29 except that the sieving conditions were changed,
Magnetic Particle Powder 32: produced in the same manner as Magnetic Particle Powder 29 except that the sieving conditions were changed,
Magnetic Particle Powder 33: produced in the same manner as Magnetic Particle Powder 29 except that the sieving conditions were changed,
Magnetic Particle Powder 34: produced in the same manner as Magnetic Particle Powder 29 except that the sieving conditions were changed,
*6 Toner 9: produced by treating Toner 8 by mechanical impact for sphericity,
Toner 10: produced from the same formulation as Toner 8 by changing pulverization conditions,
Toner 11: produced from the same formulation as Toner 8 by changing pulverization conditions and classification conditions

What is claimed is:

1. An image forming method comprising a charging step using a charging means for electrifying an image holding member for holding an electrostatic latent image; an electrostatic latent image formation step for forming an electrostatic latent image on the electrified image holding member; a development step for developing the electrostatic latent image held on the image holding member with a toner stored in a development device to form a toner image; a transfer step for transferring the toner image onto a transfer-receiving medium, and a recovery step for recovering the toner remaining after the image transfer on the image holding member simultaneously with the development by the development device, wherein the charging means is a magnetic brush charger formed from magnetically confined magnetic particles; the magnetic brush charger electrifies the image holding member by bringing the magnetic brush of the magnetic brush charger into contact with the surface of the image holding member, recovers temporarily at least a part of the toner remaining on the image holding member after the image transfer, and transfers the recovered toner further again onto the image holding member;

the toner has a weight-average particle diameter ($D_4$) of not larger than ⅓ of average particle diameter of the magnetic particles; and the magnetic particles contain particles of diameter of not larger than ⅓ of the average particle diameter of the magnetic particles at a content ranging from 0 to 5.0% by volume.

2. The image forming method according to claim 1, wherein the magnetic particles contain particles of diameter of not larger than ⅓ of the average particle diameter of the magnetic particles at a content ranging from 0 to 4.5% by volume.

3. The image forming method according to claim 1, wherein the magnetic particles contain particles of diameter of not less than 1.5 times the average particle diameter of the magnetic particles at a content ranging from 0 to 20.0% by volume.

4. The image forming method according to claim 1, wherein the magnetic particles contain particles of diameter of not less than 1.5 times the average particle diameter of the magnetic particles at a content ranging from 0 to 15.0% by volume.

5. The image forming method according to claim 1, wherein the magnetic particles contain particles of diameter of ⅔ to ⅘ of the average particle diameter of the magnetic particles at a content ranging from 60.0 to 100% by volume.

6. The image forming method according to claim 1, wherein the magnetic particles contain particles of diameter of ⅔ to ⅘ of the average particle diameter of the magnetic particles at a content ranging from 65.0 to 100% by volume.

7. The image forming method according to claim 1, wherein the magnetic particles have an average particle diameter ranging from 10 to 100 $\mu$m.

8. The image forming method according to claim 1, wherein the magnetic particles have an average particle diameter ranging from 15 to 50 $\mu$m.

9. The image forming method according to claim 1, wherein the toner has a weight-average particle diameter ($D_4$) ranging from 1 to 20 $\mu$m.

10. The image forming method according to claim 1, wherein the toner has a weight-average particle diameter ($D_4$) ranging from 2 to 10 $\mu$m.

11. The image forming method according to claim 1, wherein the toner has shape factors SF-1 ranging from 100 to 155 and SF-2 ranging from 100 to 145.

12. The image forming method according to claim 1, wherein the magnetic particles have shape factors SF-1 ranging from 100 to 150 and SF-2 ranging from 100 to 130.

13. The image forming method according to claim 1, wherein the toner has shape factors SF-1 ranging from 100 to 155 and SF-2 ranging from 100 to 145, and the magnetic particles have shape factors SF-1 ranging from 100 to 150 and SF-2 ranging from 100 to 130.

14. The image forming method according to claim 1, wherein the magnetic particles have a volume resistivity ranging from $1\times10^5$ to $1\times10^9$ Ω.cm.

15. The image forming method according to claim 1, wherein the magnetic particles are a mixture of main magnetic particles having a volume resistivity ranging from $1\times10^5$ to $1\times10^9$ Ω.cm, and auxiliary magnetic particles having a volume resistivity ranging from $1\times10^0$ to $1\times10^5$ Ω.cm.

16. The image forming method according to claim 1, wherein the magnetic particles are a mixture of main magnetic particles having a volume resistivity ranging from $1\times10^6$ to $1\times10^8$ Ω.cm, and auxiliary magnetic particles having a volume resistivity ranging from $1\times10^3$ to $1\times10^5$ Ω.cm.

17. The image forming method according to claim 1, wherein the magnetic particles, which is a mixture of main magnetic particles and auxiliary magnetic particles, contain 10 to 40 parts by weight of the auxiliary magnetic particles based on 100 parts by weight of the main magnetic particles.

18. The image forming method according to claim 1, wherein the image holding member has an outermost surface layer composed of a binder resin and electroconductive fine particles dispersed therein.

19. The image forming method according to claim 1, wherein the image holding member has an outermost surface layer of a volume resistivity of not more than $1\times10^{14}$ Ω.cm.

20. The image forming method according to claim 1, wherein the image holding member has an outermost surface layer of a volume resistivity ranging from $1\times10^9$ to $1\times10^{14}$ Ω.cm.

21. The image forming method according to claim 1, wherein the magnetic brush charger electrifies a surface layer of the image holding member by direct injection of electric charge by bringing the magnetic brush into contact with the surface of the image holding member.

22. The image forming method according to claim 1, wherein the magnetic brush charger electrifies the image holding member by application of a charging bias having a DC voltage.

23. The image forming method according to claim 1, wherein the magnetic brush charger electrifies the image holding member by application of a charging bias having a DC voltage and an AC component in superposition.

24. The image forming method according to claim 1, wherein a transfer section in the transfer step, a charging section in the charging step, and a development section in the development step are placed in the named order on the image holding member along the movement direction of the image holding member, and no cleaning member is provided which is brought into contact with the surface of the image holding member between the transfer section and the charging section, and between the charging section and the development section.

25. An image forming apparatus comprising an image holding member for holding an electrostatic latent image; a charging means for electrifying the image holding member; an electrostatic image forming means for forming an electrostatic latent image on the electrified image holding member; a development device storing a toner for toner image formation for developing the electrostatic latent image formed on the image holding member with the toner to form a toner image; and a transfer means for transferring the toner image onto a transfer-receiving medium, wherein the development device functions also to recover the toner remaining on the image holding member after the image transfer, the charging means is a magnetic brush charger formed from magnetically confined magnetic particles; the magnetic brush charger electrifies the image holding member by bringing the magnetic brush of the magnetic brush charger into contact with the surface of the image holding member, recovers temporarily at least a part of the toner remaining on the image holding member after the image transfer, and transfers the recovered toner further again onto the image holding member; the toner has a weight-average particle diameter ($D_4$) of not larger than ⅓ of average particle diameter of the magnetic particles; and the magnetic particles contain particles of diameter of not larger than ⅓ of the average particle diameter of the magnetic particles at a content ranging from 0 to 5.0% by volume.

26. The image forming apparatus according to claim 25, wherein the magnetic particles contain particles of diameter of not larger than ⅓ of the average particle diameter of the magnetic particles at a content ranging from 0 to 4.5% by volume.

27. The image forming apparatus according to claim 25, wherein the magnetic particles contain particles of diameter of not less than 1.5 times the average particle diameter of the magnetic particles at a content ranging from 0 to 20.0% by volume.

28. The image forming apparatus according to claim 25, wherein the magnetic particles contain particles of diameter of not less than 1.5 times the average particle diameter of the magnetic particles at a content ranging from 0 to 15.0% by volume.

29. The image forming apparatus according to claim 25, wherein the magnetic particles contain particles of diameter of ⅔ to ⅘ of the average particle diameter of the magnetic particles at a content ranging from 60.0 to 100% by volume.

30. The image forming apparatus according to claim 25, wherein the magnetic particles contain particles of diameter of ⅔ to ⅘ of the average particle diameter of the magnetic particles at a content ranging from 65.0 to 100% by volume.

31. The image forming apparatus according to claim 25, wherein the magnetic particles have an average particle diameter ranging from 10 to 100 μm.

32. The image forming apparatus according to claim 25, wherein the magnetic particles have an average particle diameter ranging from 15 to 50 μm.

33. The image forming apparatus according to claim 25, wherein the toner has a weight-average particle diameter ($D_4$) ranging from 1 to 20 μm.

34. The image forming apparatus according to claim 25, wherein the toner has a weight-average particle diameter ($D_4$) ranging from 2 to 10 μm.

35. The image forming apparatus according to claim 25, wherein the toner has shape factors SF-1 ranging from 100 to 155 and SF-2 ranging from 100 to 145.

36. The image forming apparatus according to claim 25, wherein the magnetic particles have shape factors SF-1 ranging from 100 to 150 and SF-2 ranging from 100 to 130.

37. The image forming apparatus according to claim 25, wherein the toner has shape factors SF-1 ranging from 100 to 155 and SF-2 ranging from 100 to 145, and the magnetic particles have shape factors SF-1 ranging from 100 to 150 and SF-2 ranging from 100 to 130.

38. The image forming apparatus according to claim 25, wherein the magnetic particles have a volume resistivity ranging from $1\times10^5$ to $1\times10^9$ Ω.cm.

39. The image forming apparatus according to claim 25, wherein the magnetic particles are a mixture of main magnetic particles having a volume resistivity ranging from $1\times10^5$ to $1\times10^9$ Ω.cm, and auxiliary magnetic particles having a volume resistivity ranging from $1\times10^0$ to $1\times10^5$ Ω.cm.

40. The image forming apparatus according to claim 25, wherein the magnetic particles are a mixture of main magnetic particles having a volume resistivity ranging from $1\times10^6$ to $1\times10^8$ Ω.cm, and auxiliary magnetic particles having a volume resistivity ranging from $1\times10^3$ to $1\times10^5$ Ω.cm.

41. The image forming apparatus according to claim 25, wherein the magnetic particles, which is a mixture of main magnetic particles and auxiliary magnetic particles, contain 10 to 40 parts by weight of the auxiliary magnetic particles based on 100 parts by weight of the main magnetic particles.

42. The image forming apparatus according to claim 25, wherein the image holding member has an outermost surface layer composed of a binder resin and electroconductive fine particles dispersed therein.

43. The image forming apparatus according to claim 25, wherein the image holding member has an outermost surface layer of a volume resistivity of not more than $1\times10^{14}$ Ω.cm.

44. The image forming apparatus according to claim 25, wherein the image holding member has an outermost surface layer of a volume resistivity ranging from $1\times10^9$ to $1\times10^{14}$ Ω.cm.

45. The image forming apparatus according to claim 25, wherein the magnetic brush charger electrifies a surface layer of the image holding member by direct injection of electric charge by bringing the magnetic brush into contact with the surface of the image holding member.

46. The image forming apparatus according to claim 25, wherein the magnetic brush charger electrifies the image holding member by application of a charging bias having a DC voltage.

47. The image forming apparatus according to claim 25, wherein the magnetic brush charger electrifies the image holding member by application of a charging bias having a DC voltage and an AC component in superposition.

48. The image forming apparatus according to claim 25, wherein a transfer section in the transfer step, a charging section in the charging step, and a development section in the development step are placed in the named order on the image holding member along the movement direction of the image holding member, and no cleaning member is provided which is brought into contact with the surface of the image holding member between the transfer section and the charging section, and between the charging section and the development section.

49. A process cartridge detachably mountable to a main assembly of an image forming apparatus, comprising an image holding member for holding an electrostatic latent image; a charging means for electrifying the image holding member; and a development device storing a toner for toner image formation for developing the electrostatic latent image formed on the image holding member with the toner to form a toner image, and a transfer means for transferring the toner image onto a transfer-receiving medium, wherein the development device functions also to recover the toner remaining on the image holding member after the image transfer, the charging means is a magnetic brush charger formed from magnetically confined magnetic particles; the magnetic brush charger electrifies the image holding member by bringing the magnetic brush of the magnetic brush charger into contact with the surface of the image holding member, recovers temporarily at least a part of the toner remaining on the image holding member after the image transfer, and transfers the recovered toner further again onto the image holding member; the toner has a weight-average particle diameter ($D_4$) of not larger than ⅓ of average particle diameter of the magnetic particles; and the magnetic particles contain particles of diameter of not larger than ⅓ of the average particle diameter of the magnetic particles at a content ranging from 0 to 5.0% by volume.

50. The process cartridge according to claim 49, wherein the magnetic particles contain particles of diameter of not larger than ⅓ of the average particle diameter of the magnetic particles at a content ranging from 0 to 4.5% by volume.

51. The process cartridge according to claim 49, wherein the magnetic particles contain particles of diameter of not less than 1.5 times the average particle diameter of the magnetic particles at a content ranging from 0 to 20.0% by volume.

52. The process cartridge according to claim 49, wherein the magnetic particles contain particles of diameter of not less than 1.5 times the average particle diameter of the magnetic particles at a content ranging from 0 to 15.0% by volume.

53. The process cartridge according to claim 49, wherein the magnetic particles contain particles of diameter of ⅔ to ⅘ of the average particle diameter of the magnetic particles at a content ranging from 60.0 to 100% by volume.

54. The process cartridge according to claim 49, wherein the magnetic particles contain particles of diameter of ⅔ to ⅘ of the average particle diameter of the magnetic particles at a content ranging from 65.0 to 100% by volume.

55. The process cartridge according to claim 49, wherein the magnetic particles have an average particle diameter ranging from 10 to 100 μm.

56. The process cartridge according to claim 49, wherein the magnetic particles have an average particle diameter ranging from 15 to 50 μm.

57. The process cartridge according to claim 49, wherein the toner has a weight-average particle diameter ($D_4$) ranging from 1 to 20 μm.

58. The process cartridge according to claim 49, wherein the toner has a weight-average particle diameter ($D_4$) ranging from 2 to 10 μm.

59. The process cartridge according to claim 49, wherein the toner has shape factors SF-1 ranging from 100 to 155 and SF-2 ranging from 100 to 145.

60. The process cartridge according to claim 49, wherein the magnetic particles have shape factor s SF-1 ranging from 100 to 150 and SF-2 ranging from 100 to 130.

61. The process cartridge according to claim 49, wherein the toner has shape factors SF-1 ranging from 100 to 155 and SF-2 ranging from 100 to 145, and the magnetic particles have shape factors SF-1 ranging from 100 to 150 and SF-2 ranging from 100 to 130.

62. The process cartridge according to claim 49, wherein the magnetic particles have a volume resistivity ranging from $1\times10^5$ to $1\times10^9$ Ω.cm.

63. The process cartridge according to claim 49, wherein the magnetic particles are a mixture of main magnetic particles having a volume resistivity ranging from $1\times10^5$ to $1\times10^9$ Ω.cm, and auxiliary magnetic particles having a volume resistivity ranging from $1\times10^0$ to $1\times10^5$ Ω.cm.

64. The process cartridge according to claim 49, wherein the magnetic particles are a mixture of main magnetic particles having a volume resistivity ranging from $1\times10^6$ to $1\times10^8$ Ω.cm, and auxiliary magnetic particles having a volume resistivity ranging from $1\times10^3$ to $1\times10^5$ Ω.cm.

65. The process cartridge according to claim 49, wherein the magnetic particles, which is a mixture of main magnetic particles and auxiliary magnetic particles, contain 10 to 40 parts by weight of the auxiliary magnetic particles based on 100 parts by weight of the main magnetic particles.

66. The process cartridge according to claim 49, wherein the image holding member has an outermost surface layer composed of a binder resin and electroconductive fine particles dispersed therein.

67. The process cartridge according to claim 49, wherein the image holding member has an outermost surface layer of a volume resistivity of not more than $1\times10^{14}$ Ω.cm.

68. The process cartridge according to claim 49, wherein the image holding member has an outermost surface layer of a volume resistivity ranging from $1\times10^9$ to $1\times10^{14}$ Ω.cm.

69. The process cartridge according to claim 49, wherein the magnetic brush charger electrifies a surface layer of the image holding member by direct injection of electric charge by bringing the magnetic brush into contact with the surface of the image holding member.

70. The process cartridge according to claim 49, wherein the magnetic brush charger electrifies the image holding member by application of a charging bias having a DC voltage.

71. The process cartridge according to claim 49, wherein the magnetic brush charger electrifies the image holding member by application of a charging bias having a DC voltage and an AC component in superposition.

72. The process cartridge according to claim 49, wherein a transfer section in the transfer step, a charging section in the charging step, and a development section in the development step are placed in the named order on the image holding member along the movement direction of the image holding member, and no cleaning member is provided which brought into contact with the surface of the image holding member between the transfer section and the charging section, and between the charging section and the development section.

* * * * *

UNITED STATES PATENT AND TRADEMARK OFFICE

CERTIFICATE OF CORRECTION

PATENT NO. : 6,002,900

DATED : December 14, 1999

INVENTOR(S) : HARUMI ISHIYAMA

It is certified that error appears in the above-identified patent and that said Letters Patent is hereby corrected as shown below:

COLUMN 1:

Line 34, "an" should read --a--.

COLUMN 3:

Line 61, "investigation" should read --investigations--.

COLUMN 4:

Line 13, "recoverablilty" should read --recoverability--.

COLUMN 5:

Line 17, "of" should read --is--.

COLUMN 6:

Line 49, "is" should read --are--; and
Line 61, "arises" should read --arise--.

COLUMN 7:

Line 6, "contains" should read --contain--;
Line 18, "contains" should read --contain--;
Line 29, "contains" should read --contain--; and
Line 38, "has" should read --have--.

UNITED STATES PATENT AND TRADEMARK OFFICE

CERTIFICATE OF CORRECTION

PATENT NO. : 6,002,900

DATED : December 14, 1999

INVENTOR(S) : HARUMI ISHIYAMA

It is certified that error appears in the above-identified patent and that said Letters Patent is hereby corrected as shown below:

COLUMN 8:

Line 4, "are" should read --is--;
Line 5, "explaned" should read --explained--; and
Line 30, "blush" should read --brush--.

COLUMN 10:

Line 42, delete "an".

COLUMN 11:

Line 10, "prevents" should read --prevent--;
Line 21, "has" should read --have--;
Line 27, delete "of"; and
Line 37, "has" should read --have--.

COLUMN 12:

Line 22, "has" should read --have--;
Line 32, "causes" should read --cause--; and
Line 47, delete "an".

COLUMN 13:

Line 13, "is" should read --are--.

UNITED STATES PATENT AND TRADEMARK OFFICE

CERTIFICATE OF CORRECTION

PATENT NO. : 6,002,900

DATED : December 14, 1999

INVENTOR(S) : HARUMI ISHIYAMA

It is certified that error appears in the above-identified patent and that said Letters Patent is hereby corrected as shown below:

COLUMN 14:

Line 24, "mean" should read --means--;
Line 40, "5200" should read --5 to 200--.

COLUMN 15:

Line 16, "(First" should read --(first--.

COLUMN 16:

Line 17, delete "is".

COLUMN 17:

Line 41, "method" should read --methods--; and
Line 46, delete "a".

COLUMN 20:

Line 32, "are" should read --is--.

COLUMN 22:

Line 2, delete "preferably"; and
Line 15, "transfer" should read --transfers--.

UNITED STATES PATENT AND TRADEMARK OFFICE

CERTIFICATE OF CORRECTION

PATENT NO. : 6,002,900

DATED : December 14, 1999

INVENTOR(S) : HARUMI ISHIYAMA

It is certified that error appears in the above-identified patent and that said Letters Patent is hereby corrected as shown below:

COLUMN 23:

Line 6, "store" should read --stored--;
Line 37, "recoverablilty" should read --recoverability--; and
Line 46, "holing" should read --holding--.

COLUMN 25:

Line 65, "lightly" should read --slightly--.

COLUMN 26:

Line 15, "was" should read --were--;
Line 17, "was" should read --were--;
Line 48, "particle" should read --particles--;
Line 52, "particle" should read --particles--; and
Line 64, delete "a".

COLUMN 27:

Line 14, delete "a";
Line 15, "Tone 6" should read --Toner 6--; and
Line 59, "$8x10^{7}$ Ω.cm." should read --$8x10^{7}$ Ω.cm.--.

UNITED STATES PATENT AND TRADEMARK OFFICE

CERTIFICATE OF CORRECTION

PATENT NO. : 6,002,900

DATED : December 14, 1999

INVENTOR(S) : HARUMI ISHIYAMA

It is certified that error appears in the above-identified patent and that said Letters Patent is hereby corrected as shown below:

COLUMN 30:

TABLE 3 after Example 17, "129" should read --120--;
TABLE 3 after Example 6, "0.20" should read --0.32--; and
TABLE 3 after Example 7, "0.28" should read --0.20--.

COLUMN 31:

TABLE 3-Continued, "Magnetic particle Powder 4" should read --Magnetic Particle Powder 4--;
TABLE 4, "No.*1" should read --No.*3--; and
TABLE 4 after Comparative Example 5, "1.o" should read --1.0--.

COLUMN 33:

TABLE 4-Continued, "Charging ability _____" should read --Charging Ability-- and "particies)" should read --particles)--; and
TABLE 5, "500-sheet 1000-sheet" should read --5000-sheet 10000-sheet--

COLUMN 37:

Line 10, "medium," should read --medium;--.

UNITED STATES PATENT AND TRADEMARK OFFICE

CERTIFICATE OF CORRECTION

PATENT NO. : 6,002,900

DATED : December 14, 1999

INVENTOR(S) : HARUMI ISHIYAMA

It is certified that error appears in the above-identified patent and that said Letters Patent is hereby corrected as shown below:

COLUMN 41:

Line 56, "factor s" should read --factors--.

COLUMN 42:

Line 19, "is" should read --are--;
Line 52, "brought" should read --is brought--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*